US008698111B2

(12) United States Patent
Nishisaka et al.

(10) Patent No.: US 8,698,111 B2
(45) Date of Patent: Apr. 15, 2014

(54) EXTREME ULTRAVIOLET LIGHT GENERATION SYSTEM

(75) Inventors: Toshihiro Nishisaka, Hiratsuka (JP); Yukio Watanabe, Hiratsuka (JP); Osamu Wakabayashi, Hiratsuka (JP); Hideo Hoshino, Hiratsuka (JP)

(73) Assignee: Gigaphonton Inc., Tochigi (JP)

( * ) Notice: Subject to any disclaimer, the term of this patent is extended or adjusted under 35 U.S.C. 154(b) by 189 days.

(21) Appl. No.: 13/283,922

(22) Filed: Oct. 28, 2011

(65) Prior Publication Data

US 2012/0104290 A1 May 3, 2012

(30) Foreign Application Priority Data

Oct. 29, 2010 (JP) ..... 2010-243619
Sep. 5, 2011 (JP) ..... 2011-192861

(51) Int. Cl.
*G21G 4/00* (2006.01)

(52) U.S. Cl.
USPC ..... 250/493.1; 250/503.1

(58) Field of Classification Search
USPC ..... 250/493.1, 496.1, 497.1, 498.1, 503.1, 250/504 R
See application file for complete search history.

(56) References Cited

U.S. PATENT DOCUMENTS

2008/0023657 A1* 1/2008 Melnychuk et al. ..... 250/504 R
2010/0019173 A1* 1/2010 Someya et al. ..... 250/496.1
2010/0051832 A1* 3/2010 Nishisaka et al. ..... 250/504 R

FOREIGN PATENT DOCUMENTS

JP 63-157485 6/1988
JP 05-167135 7/1993

* cited by examiner

*Primary Examiner* — Robert Kim
*Assistant Examiner* — Hanway Chang
(74) *Attorney, Agent, or Firm* — McDermott Will & Emery LLP

(57) ABSTRACT

An apparatus for generating extreme ultraviolet light by exciting a target material to turn the target material into plasma may include: a frame; a chamber in which the extreme ultraviolet light is generated; a target supply unit for supplying the target material into the chamber; a first connection member for connecting the frame and the chamber flexibly; a mechanism for fixing the target supply unit to the frame; and a second connection member for connecting the target supply unit to the chamber flexibly.

9 Claims, 15 Drawing Sheets

EXTREME ULTRAVIOLET LIGHT GENERATION SYSTEM

CROSS-REFERENCE TO RELATED APPLICATIONS

The application claims priority of Japanese Patent Application No. 2010-243619, filed Oct. 29, 2010, and Japanese Patent Application No. 2011-192861, filed Sep. 5, 2011, the entire contents of each of which are hereby incorporated by reference.

BACKGROUND

1. Technical Field

This disclosure relates to an apparatus and a system for generating extreme ultraviolet (EUV) light.

2. Related Art

Photolithography processes have been continuously improving for semiconductor device fabrication. Extreme ultraviolet (EUV) light at a wavelength of approximately 13 nm is useful in the photolithography processes to form extremely small features (e.g., 32 nm or less features) in, for example, semiconductor wafers.

Three types of system for generating EUV light have been well known. The systems include an LPP (Laser Produced Plasma) type system in which plasma generated by irradiating a target material with a laser beam is used, a DPP (Discharge Produced Plasma) type system in which plasma generated by electric discharge is used, and an SR (Synchrotron Radiation) type system in which orbital radiation is used.

SUMMARY

An apparatus according to one aspect of this disclosure for generating extreme ultraviolet light by exciting a target material to turn the target material into plasma may include: a frame; a chamber in which the extreme ultraviolet light is generated; a target supply unit for supplying the target material into the chamber; a first connection member for connecting the frame and the chamber flexibly; a mechanism for fixing the target supply unit to the frame; and a second connection member for connecting the target supply unit to the chamber flexibly.

A system according to another aspect of this disclosure for generating extreme ultraviolet light by exciting a target material to turn the target material into plasma may include: a frame; a chamber in which the extreme ultraviolet light is generated; a target supply unit for supplying the target material into the chamber; a first connection member for connecting the frame and the chamber flexibly; a mechanism for fixing the target supply unit to the frame; a second connection member for connecting the target supply unit to the chamber flexibly; a driver laser configured to output a laser beam, with which the target material supplied into the chamber from the target supply unit is irradiated; a mirror, fixed to the frame, for reflecting the laser beam in the chamber; and a beam dump positioned to absorb the laser beam reflected by the mirror.

DESCRIPTION OF THE EMBODIMENTS

Hereinafter, selected embodiments of this disclosure will be described in detail with reference to the accompanying drawings. The embodiments to be described below are merely illustrative in nature and do not limit the scope of this disclosure. Further, configurations and operations described in each embodiment are not all essential in implementing this disclosure. It should be noted that like elements are referenced by like referential symbols and duplicate descriptions thereof will be omitted herein.

First Embodiment

Figure 1:
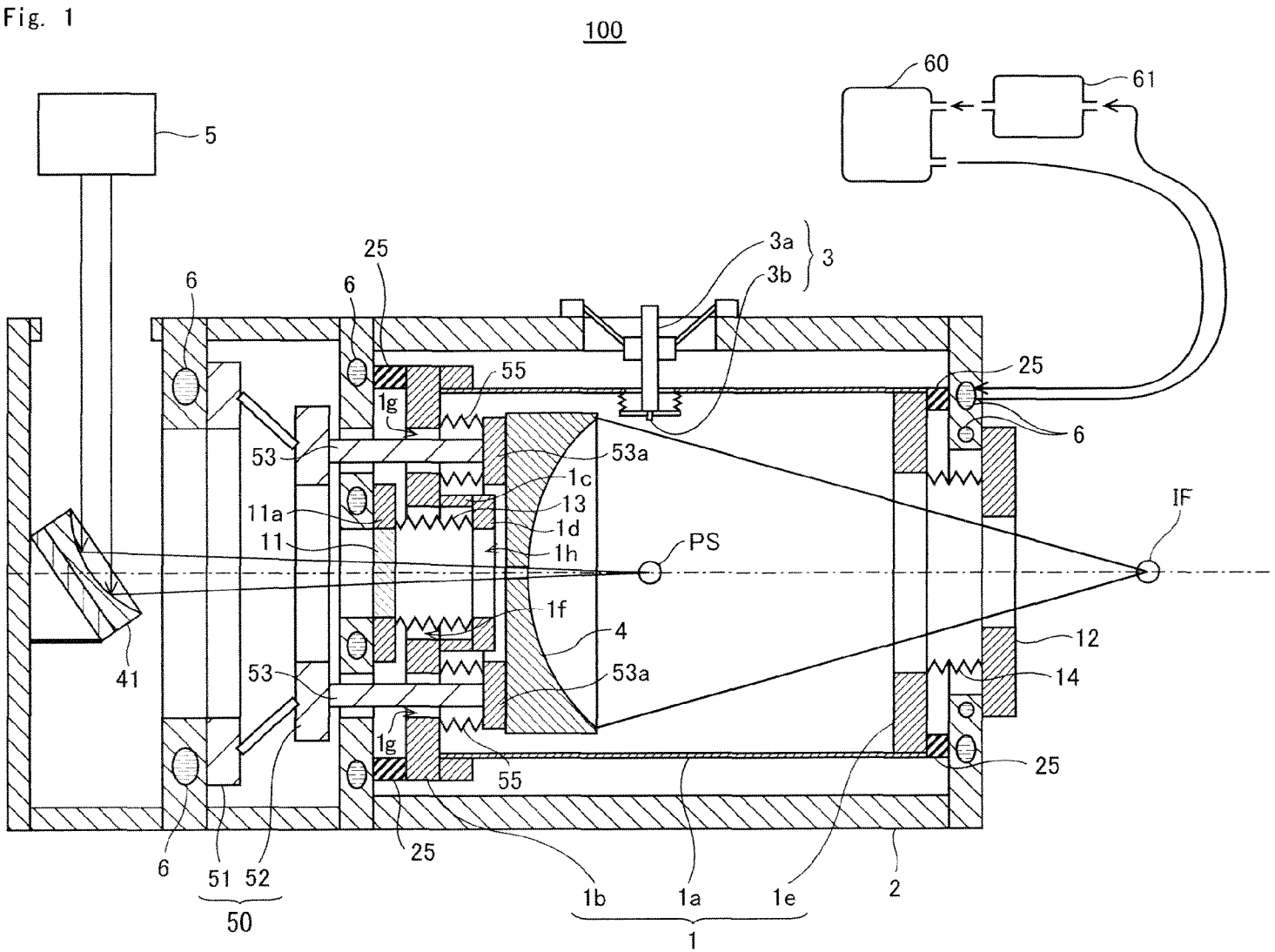
FIG. 1 is a sectional view schematically illustrating the configuration of an EUV light generation system according to a first embodiment of this disclosure.

FIG. 1 is a sectional view schematically illustrating the configuration of an EUV light generation system according to a first embodiment of this disclosure. An EUV light generation system 100 may be an LPP type system. As illustrated in FIG. 1, the EUV light generation system 100 may include a chamber 1, a support frame 2, a target supply unit 3, an EUV collector mirror 4, and a driver laser 5.

The chamber 1 may be configured to define a space thereinside in which EUV light is generated. The interior of the chamber 1 may be maintained at pressure lower than atmospheric pressure. The chamber 1 may include a cylindrical chamber wall 1*a* and disc-shaped chamber walls 1*b* and 1*e*. The disc-shaped chamber walls 1*b* and 1*e* may be airtightly fixed to the respective ends of the cylindrical chamber wall 1*a*.

The chamber wall 1*b* may have a through-hole 1*f* formed at the center thereof. Inside the chamber 1, a cylindrical member 1*c* may be disposed so as to connect a disc 1*d*, at the periphery thereof, to the chamber wall 1*b*, at the periphery of the through-hole 1*f* formed therein. The disc 1*d* may have a through-hole 1*h* formed at the center thereof. A flexible pipe 13 may be disposed so as to connect the disc 1*d*, at the periphery of the through-hole 1*h* formed therein, to a holder 11*a* for supporting a laser beam transmission window 11. The laser beam transmission window 11 may allow a laser beam outputted from the driver laser 5 to be transmitted therethrough into the chamber 1. The holder 11*a* may be airtightly fixed to the laser beam transmission window 11, at the periphery thereof. Such configuration may allow the through-hole 1*f* to be sealed.

A plurality of through-holes 1*g* may be formed in the chamber wall 1*b*, surrounding the through-hole 1*f*. The through-holes 1*g* may be sealed by a flexible pipe 55 and a mirror holder 53*a*.

The chamber 1 may further include a connection 12 provided with an opening through which the EUV light generated inside the chamber 1 may be outputted to a processing apparatus such as an exposure apparatus including a projection optical system. A flexible pipe 14 may be disposed so as to connect the chamber wall 1*e*, at the periphery of a through-hole provided at the center thereof, and the connection 12, at the periphery thereof. As a result, the opening in the connection 12 may be in communication with the through-hole in the chamber wall 1*e* via the flexible pipe 14. The flexible pipes 13 and 14 may preferably be pleated flexible pipes so as to stand the stress caused by a difference in pressure inside and outside the chamber 1.

The support frame 2 may be positioned precisely with respect to the mechanical reference plane, and may function to support and secure the target supply unit 3, the EUV collector mirror 4, and so forth, at predetermined positions. The holder 11*a* for supporting the laser beam transmission window 11 and the connection 12 may be fixed to the support frame 2. Further, the support frame 2 may be connected flexibly to the chamber 1 via an elastic member 25.

The target supply unit 3 may be configured to supply a target material, such as tin (Sn), lithium (Li), and so forth, used to generate the EUV light into the chamber 1. The target supply unit 3 may include a tank 3*a* for storing the target material thereinside, and a nozzle 3*b* through which the target material inside the tank 3*a* is outputted into the chamber 1.

The target supply unit 3 may be configured to supply the target material into the chamber 1 in any of the known modes, such as a continuous jet, a droplet, and so forth. For example, in a case where tin is used as the target material in a molten state, the target supply unit 3 may include a heater for heating tin, a gas cylinder for supplying a pure argon gas for pressurizing molten tin, and a mass flow controller for controlling the flow rate of the pure argon gas.

The driver laser 5 may be configured to output a laser beam used to excite the target material to turn it into plasma. The driver laser 5 may, for example, be a Master-Oscillator Power-Amplifier (MOPA) type laser apparatus. The laser beam outputted from the driver laser 5 may be introduced into the chamber 1 via an optical system and the laser beam transmission window 11. The optical system may include a laser beam focusing mirror 41, a lens, and so forth. The laser beam introduced into the chamber 1 may travel through the through-hole formed in the EUV collector mirror 4 and be focused on a predetermined plasma generation region PS inside the chamber 1. In the plasma generation region PS, the target material may be irradiated with the laser beam, turning the target material into plasma. Rays of light at various wavelengths, including the EUV light, may be emitted from this plasma. The laser beam focusing mirror 41 may be supported by the support frame 2 for maintaining the laser beam focusing mirror 41 at a desired position and in a desired posture with respect to the mechanical reference plane even when the chamber 1 undergoes thermal expansion.

The EUV collector mirror 4 may be disposed inside the chamber 1. The EUV collector mirror 4 may have a multilayer coating, constituting a reflective surface thereof, for reflecting the EUV light at a predetermined wavelength with high reflectivity. For example, a mirror on which molybdenum (Mo) and silicon (Si) are alternately layered may be used as a mirror for selectively reflecting the EUV light at a wavelength of approximately 13.5 nm. The reflective surface of the EUV collector mirror 4 may be ellipsoidal in shape. The EUV collector mirror 4 may be disposed such that the first focus thereof lies on the plasma generation region PS. The EUV light reflected by the EUV collector mirror 4 may be focused on the second focus thereof, which may coincide with an intermediate focus IF.

As described above, the target material supplied into the chamber 1 may be irradiated with the laser beam, which can turn the target material into plasma. Rays of light at various wavelengths, including the EUV light, may be emitted from this plasma. Of the rays of light emitted from the plasma, the EUV light at a predetermined wavelength (13.5 nm, for example) may be reflected by the EUV collector mirror 4 with high reflectivity. The EUV light reflected by the EUV collector mirror 4 may be outputted, via the opening in the connection 12, into the processing apparatus, such as an exposure apparatus including a projection optical system connected outside the chamber 1.

In the first embodiment, the EUV light generation system 100 including the driver laser 5 is described, but this disclosure is not limited thereto. This disclosure may be applied to an apparatus in which excitation energy outputted from an external apparatus aside from the driver laser 5 is introduced into the chamber 1 to excite the target material inside the chamber 1 so as to generate the EUV light. An apparatus to be used with an external apparatus, such as the driver laser 5, to generate the EUV light may be referred to as an EUV light generation apparatus. Further, the projection optical system in the exposure apparatus is indicated above as the processing apparatus in which processing is performed with the EUV light. However, the processing apparatus is not limited thereto and may be a reticle inspection apparatus (mask inspection apparatus).

Configuration for Supporting Target Supply Unit

Figure 2:
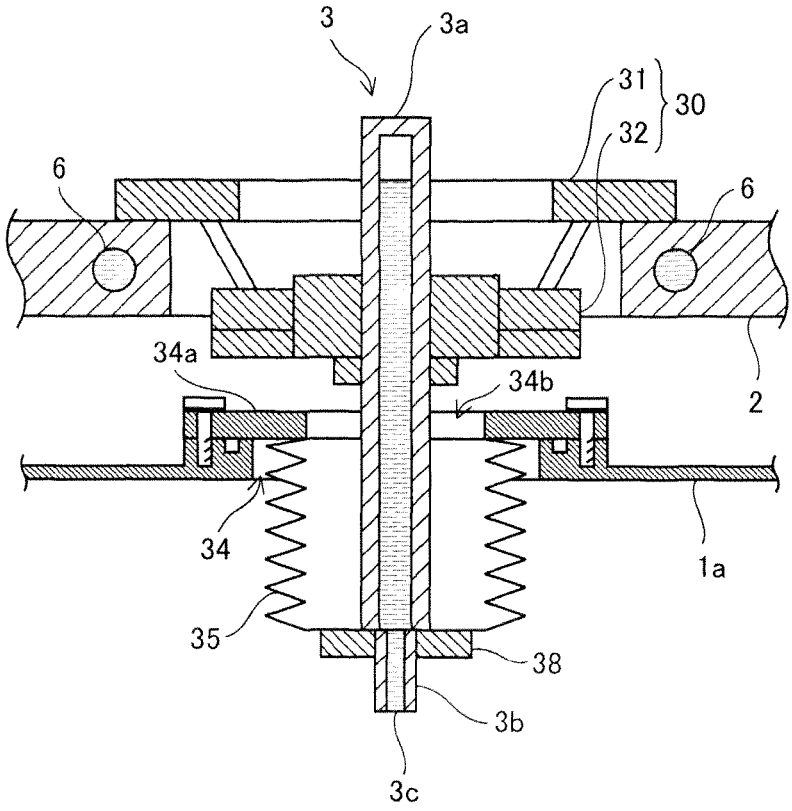
FIG. 2 is a sectional view illustrating the configuration for supporting a target supply unit in the EUV light generation system according to the first embodiment.

FIG. 2 is a sectional view illustrating the configuration for supporting the target supply unit in the EUV light generation system according to the first embodiment of this disclosure.

The target supply unit 3 may preferably be maintained in a desired position with respect to the mechanical reference plane so as to supply the target material precisely to the plasma generation region PS. Components of the chamber 1, such as the chamber wall 1*a*, may be heated by radiant heat from the plasma, scattered energy which has not been used to excite the target material (in an LPP type system, scattered energy of the laser beam), and so forth, to thereby be expanded and deformed. Accordingly, in a case where the target supply unit 3 is supported by the chamber wall 1*a*, the position of the target supply unit 3 may be shifted due to the deformation in the chamber wall 1*a*. As a result, the target material may not be supplied precisely to the plasma generation region PS. Thus, in the first embodiment, the target supply unit 3 may be supported by the support frame 2.

In the first embodiment, the support frame 2 may be disposed outside the chamber 1. Thus, the support frame 2 may be less likely to be exposed directly to the radiant heat from the plasma, the scattered energy of the laser beam, and so forth. Accordingly, components of the support frame 2 may be less likely to be heated than the components of the chamber 1, such as the chamber wall 1*a*, and deformation of the support frame 2 due to thermal expansion may be suppressed.

A coefficient of thermal expansion of components of the support frame 2 may be smaller than a coefficient of thermal expansion of components of the chamber 1, such as the chamber wall 1*a*. In that case, a deformation amount of the support frame 2 may be further smaller. Materials with a small coefficient of thermal expansion may include mullite ceramics, β-cordierite ceramics, and so forth.

An fixing plate 31 of a six-axis stage 30 may be fixed to the support frame 2. A movable plate 32 of the six-axis stage 30 may be fixed to the tank 3*a* of the target supply unit 3. The position and the inclination of the movable plate 32 may be adjusted with respect to the fixing plate 31 by actuating an actuator of the six-axis stage 30. Accordingly, the position and the inclination of the target supply unit 3 may be adjusted with respect to the support frame 2.

The chamber 1 may further include a chamber lid 34*a*. The chamber wall 1*a* may have an opening 34 formed therein. The chamber lid 34*a* may be airtightly fixed to the chamber wall 1*a* at the periphery of the opening 34 so as to seal the chamber 1. The chamber lid 34*a* may have a through-hole 34*b* formed therein in a region surrounded by a portion at which the chamber lid 34*a* is fixed to the chamber wall 1*a*. The target supply unit 3 may be inserted into the through-hole 34*b* of the chamber lid 34*a*. The target supply unit 3 may include a flange 38 disposed between a portion at which the tank 3*a* is fixed to the movable plate 32 and the leading end of the nozzle 3*b*.

Inside the chamber 1, a flexible pipe 35 may be disposed so as to connect the chamber wall 1*a* and the flange 38. More specifically, the flexible pipe 35 may be connected, at one end thereof, airtightly to the chamber lid 34*a*, at the periphery of the through-hole 34*b* formed therein. Further, the flexible pipe 35 may be connected, at the other end thereof, airtightly to the flange 38. In this way, the flexible pipe 35 may be disposed so as to connect the chamber lid 34*a*, at the periphery of the through-hole 34*b* formed therein, and the flange 38 to seal the chamber 1. Further, the flexible pipe 34 may preferably be a pleated flexible pipe so as to stand the stress caused by a difference in pressure inside and outside the chamber 1. In this way, the target supply unit 3 and the chamber 1 are connected flexibly while maintaining airtightness of the chamber 1.

Such configuration may allow the interior of the chamber 1 to be maintained at low pressure and the target supply unit 3 to be held such that the position thereof can be adjusted by the six-axis stage 30. Further, the support frame 2 may be less likely to be exposed directly to the radiant heat from the high-temperature plasma generated inside the chamber 1, and less likely to be heated than the components of the chamber 1, such as the chamber wall 1*a*, and thermal deformation in the support frame 2 may be suppressed. According to the first embodiment, since the target supply unit 3 may be supported by the support frame 2, the positional shift of the target supply unit 3 may be suppressed.

In addition, in the first embodiment, the support frame 2 may be disposed outside the chamber 1 in its entirety. Accordingly, the chamber 1 need not be increased in size in order to reduce thermal deformation in the components of the chamber 1, such as the chamber wall 1*a*. This can reduce the chamber 1 in weight and in thickness. Accordingly, the chamber 1 may be manufactured at a relatively low cost.

Further, in the first embodiment, the six-axis stage 30 may be disposed outside the chamber 1. Accordingly, the six-axis stage 30 need not be treated for vacuum use, such as vaporization control of lubricant, which allows the six-axis stage 30 to be reduced in cost. Further, lubricant or the like for the six-axis stage 30 may be less likely to be scatted in the chamber 1, which may suppress contamination of the processing apparatus, such as the projection optical system in the exposure apparatus, by the lubricant or the like.

Aside from the above-described components, the EUV light generation system 100 may include, but not limited to, an ion collection unit for collecting ions generated when the target material is turned into plasma in the chamber 1, and a radical source for supplying hydrogen radicals (H) into the chamber 1 for cleaning the EUV collector mirror and other components in the chamber. Such ion collection unit and radical source need not be positioned precisely, different from the target supply unit. Thus, they may be supported by the chamber wall 1*a*.

Configuration for Supporting EUV Collector Mirror

Referring again to FIG. 1, the configuration for supporting the EUV collector mirror 4 will be described. The EUV collector mirror 4 may preferably be maintained at a desired position and in a desired posture with respect to the mechanical reference plane, so that the EUV light is focused precisely and accurately on the intermediate focus IF defined by the specifications of the processing apparatus such as the projection optical system in the exposure apparatus. Components of the chamber 1, such as the chamber wall 1*a*, may be heated by radiant heat from the plasma, scattered energy which has not been used to excite the target material, and so forth, and may expand and deform. Accordingly, in a case where the EUV collector mirror 4 is supported by the chamber wall 1*a*, the position of the EUV collector mirror 4 may be shifted due to the deformation of the chamber wall 1*a*, and thus the EUV light may not be focused on the intermediate focus IF. Therefore, the EUV collector mirror 4 may be supported by the support frame 2.

An fixing plate 51 of a six-axis stage 50 may be fixed to the support frame 2. The EUV collector mirror 4 may be fixed to a movable plate 52 of the six-axis stage 50 via a support rod (fixing member) 53. Accordingly, the position and the inclination of the movable plate 52 may be adjusted with respect to the fixing plate 51 by actuating an actuator of the six-axis stage 50. The position and the inclination of the EUV collector mirror 4 may be adjusted with respect to the support frame 2.

The support rod 53 may be inserted into the through-hole 1*g* formed in the chamber wall 1*b*. The support rod 53 may be connected, at one end thereof, to the movable plate 52 of the six-axis stage 50 and, at the other end thereof, to the mirror holder 53*a* for supporting the EUV collector mirror 4. Inside the chamber 1, the flexible pipe 55 may be disposed so as to connect the chamber wall 1*b* and the mirror holder 53*a*. More specifically, the flexible pipe 55 may be connected, atone end thereof, airtightly to the chamber wall 1*b*, at the periphery of the through-hole 1*g* formed therein. Further, the flexible pipe 55 may be connected, at the other end thereof, airtightly to the mirror holder 53*a*. The flexible pipe 55 may be disposed so as to connect the chamber wall 1*b*, at the periphery of the through-hole 1*g* formed therein, and the mirror holder 53*a*, to seal the chamber 1. Further, the flexible pipe 55 may preferably be a pleated flexible pipe so as to stand the stress caused by a difference in pressure inside and outside the chamber 1. In this way, the EUV collector mirror 4 and the chamber wall 1*b* may be connected flexibly while maintaining airtightness of the chamber 1.

Such configuration may allow the interior of the chamber 1 to be maintained at low pressure and the EUV collector mirror 4 to be held such that the position thereof can be adjusted by the six-axis stage 50 and the support rod 53. Further, the six-axis stage 50 and the support frame 2, to which the six-axis stage 50 is mounted, may be less likely to be exposed directly to the radiant heat from the high-temperature plasma generated inside the chamber 1, and less likely to be heated than the components of the chamber 1, such as the chamber wall 1*a*, and thermal deformation in the support frame 2 may be suppressed. According to the first embodiment, because the EUV collector mirror 4 may be supported by the support frame 2, the positional shift of the EUV collector mirror 4 may be suppressed.

As described above, in the first embodiment, the support frame 2 may be disposed outside the chamber 1 in order to suppress deformation of the support frame 2 due to thermal expansion thereof. In the first embodiment, the support frame 2 can be provided with a cooling mechanism including a cooling medium channel 6, for example to suppress the thermal expansion of the support frame 2.

As illustrated in FIG. 1, the cooling medium channel 6 may be in communication with a pump 60 and a heat exchanger 61. A cooling medium, such as water, cooled in the heat exchanger 61 may be fed into the cooling medium channel 6 by the pump 60. The cooling medium channel 6 may be formed in portions of the support frame 2 which are more likely to be heated.

For example, the six-axis stage 50 may support the EUV collector mirror 4 inside the chamber 1 via the support rod 53. Thus, the six-axis stage 50 may be heated by heat transferred from the EUV collector mirror 4. Heat at the six-axis stage 50 may further be transferred to the support frame 2, and the support frame may be heated. Accordingly, the cooling medium channel 6 may be provided in a portion of the support frame 2 which supports the six-axis stage 50.

The elastic member 25 may connect the chamber 1 to the support frame 2. Thus, the elastic member 25 may be heated by heat transferred from the chamber 1. Heat transferred to the elastic member 25 may further be transferred to the support frame 2, and the support frame may be heated. Accordingly, the cooling medium channel 6 may be provided in a portion of the support frame 2 to which the elastic member 25 is fixed.

Since the laser beam transmission window 11 and the connection 12 are exposed inside the chamber 1, the window 11 and the connection 12 may be heated by the radiant heat from the plasma or the scattered energy of the laser beam. The holder 11*a* for the laser beam transmission window 11 and the connection 12 may be fixed to the support frame 2. Thus, heat transferred to the holder 11*a* and the connection 12 may further be transferred to the support frame 2, and the support frame may also be heated. Accordingly, the cooling medium channel 6 may be provided in portions of the support frame 2 to which the holder 11 and the connection 12 are fixed, respectively.

Further, as illustrated in FIG. 2, the six-axis stage 30 may support the target supply unit 3. Thus, the six-axis stage 30 may be heated by heat transferred from the target supply unit 3. Heat transferred to the six-axis stage 30 may further be transferred to the support frame 2, and the support frame may also be heated. Accordingly, the cooling medium channel 6 may be provided in a portion of the support frame 2 to which the six-axis stage 30 may be fixed. Thermal expansion in the support frame 2 may therefore be suppressed.

Examples of Cooling Mechanism

Figure 3A:
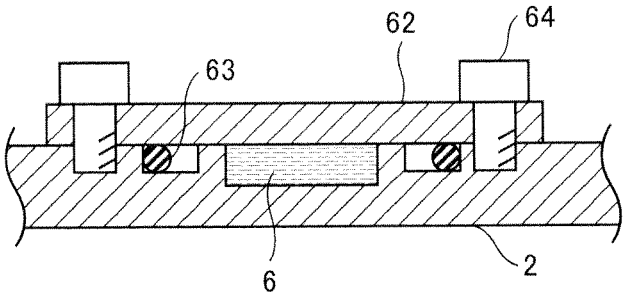
FIG. 3A is a sectional view illustrating a first example of a cooling mechanism according to the first embodiment.
Figure 3B:
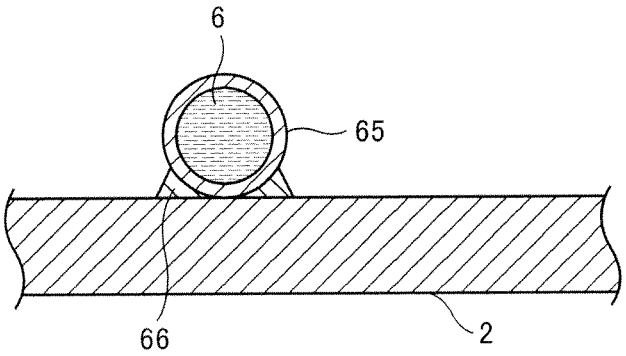
FIG. 3B is a sectional view illustrating a second example of a cooling mechanism according to the first embodiment.
Figure 3C:
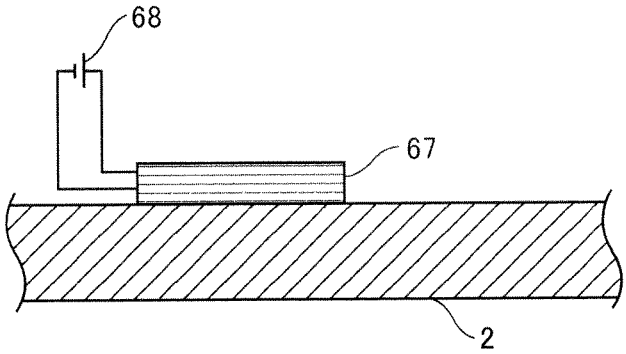
FIG. 3C is a sectional view illustrating a third example of a cooling mechanism according to the first embodiment.

FIGS. 3A through 3C are sectional views illustrating examples of the cooling mechanism according to the first embodiment. As illustrated in FIG. 3A, for example, a sealing plate 62 may be attached by bolts 64 onto an outer surface of the support frame 2 having a groove serving as the cooling medium channel 6. The cooling medium channel 6 may be formed between the support frame 2 and the sealing plate 62. A sealing member 63 may be provided in both sides of the cooling medium channel 6 along the direction in which the cooling medium flows inside the cooling medium channel 6 (direction perpendicular to paper face in FIG. 3A). Leakage through the sealing plane between the support frame 2 and the sealing plate 62 may therefore be prevented.

Further, as illustrated in FIG. 3B, a cooling medium pipe 65 may be fixed onto the outer surface of the support frame 2 with a thermal conductive adhesive 66, a thermal conductive cement, or the like to form the cooling medium channel 6.

Furthermore, as illustrated in FIG. 3C, a cooling mechanism including a thermoelectric element 67 may be provided on the outer surface of the support frame 2. In a case where a Peltier element, for example, is used as the thermoelectric element 67, a DC power source 68 may be connected to the thermoelectric element 67 and the DC power source 68 may be operated, which may cause thermal energy to be transferred from one surface to the other surface of the thermoelectric element 67. As a result, external heat may be absorbed at one surface of the thermoelectric element 67, and the heat may be emitted from the other surface thereof. Accordingly, the thermoelectric element 67 may be mounted on the support frame 2 with the heat absorbing side adhered onto the support frame 2, and the DC power source 68 may be operated to cool the support frame 2.

Figure 4A:
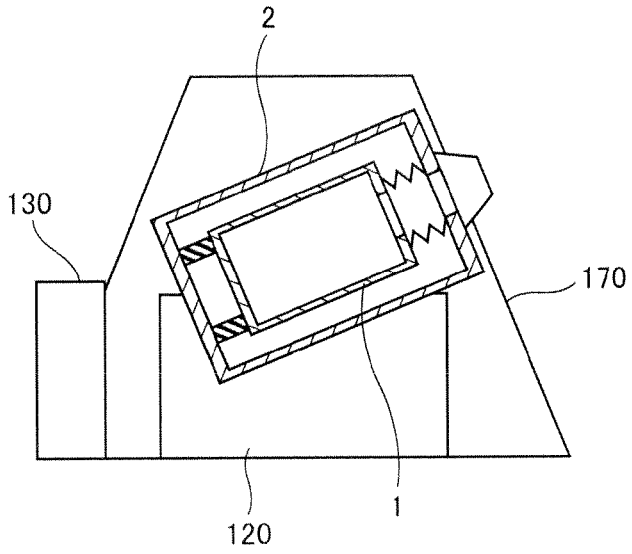
FIG. 4A is a sectional view illustrating a fourth example of a cooling mechanism according to the first embodiment.
Figure 4B:
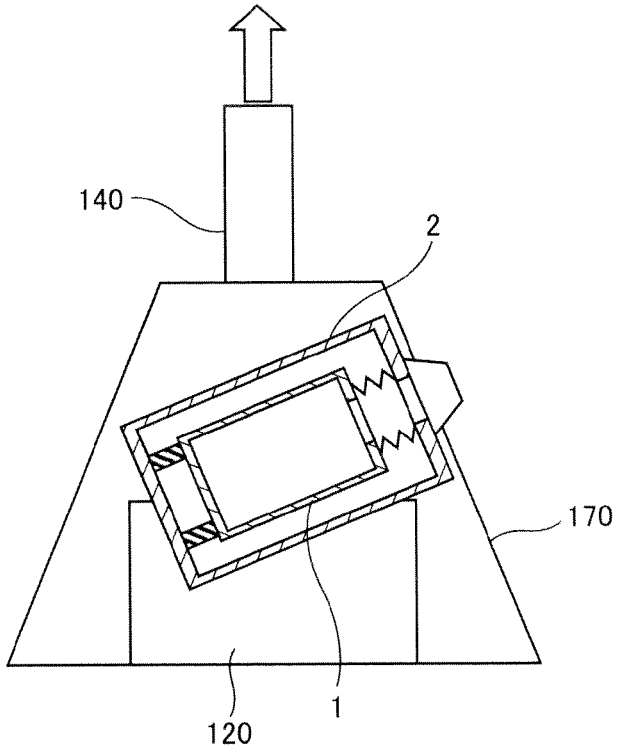
FIG. 4B is a sectional view illustrating a fifth example of a cooling mechanism according to the first embodiment.

FIGS. 4A and 4B are sectional views illustrating other examples of the cooling mechanism according to the first embodiment. As illustrated in FIG. 4A, the chamber 1 may be connected flexibly to the support frame 2 disposed outside the chamber 1, and the support frame 2 may be supported by a frame support stand 120. The chamber 1, the support frame 2, and the frame support stand 120 may be covered by a housing cover 170. The cooling mechanism may include the housing cover 170 and an air-conditioning mechanism for cooling the air inside the housing cover 170.

Further, as illustrated in FIG. 4B, the cooling mechanism may include the housing cover 170 and a heat exhaust duct 140 in communication with a heat exhaust floor (not shown) for exhausting the air inside the housing cover 170.

Second Embodiment

Figure 5:
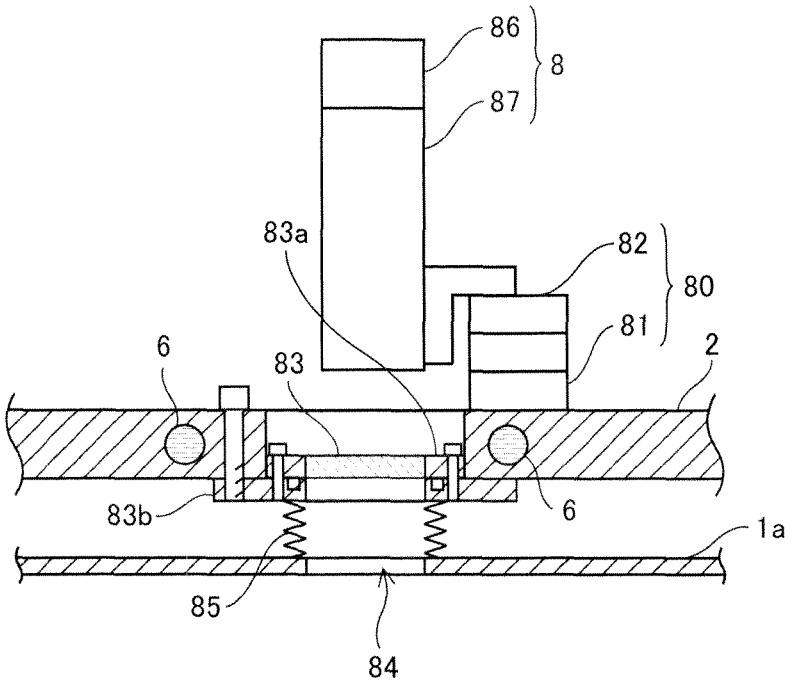
FIG. 5 is a sectional view illustrating the configuration for supporting a target sensor in an EUV light generation system according to a second embodiment of this disclosure.

FIG. 5 is a sectional view illustrating the configuration for supporting a target sensor in an EUV light generation system according to a second embodiment of this disclosure. The EUV light generation system according to the second embodiment may include a target sensor 8 for capturing an image of the target material supplied into the chamber 1. A plurality of target sensors 8 may be employed. Other configurations may be similar to those of the first embodiment.

The target sensor 8 may include, for example, a CCD (charge coupled device) image sensor 86 and an optical system 87 including at least one lens, and may be configured to capture an image inside the chamber 1 and output image data. An image processing device to be provided separately may analyze and process the image data. As a result, a trajectory of the target material provided into the chamber 1 and traveling thereinside may be detected by the image processing device. In a case where a plurality of target sensors 8 are used, the image processing device may detect the spatial position of the trajectory of the target material three-dimensionally from the plurality of the captured image data. The detection result may, for example, be fed back to control the six-axis stage 30 (See FIG. 2) described in the first embodiment. Thus, the position of the target supply unit 3 may be controlled so that the target material is supplied precisely to the plasma generation region PS.

The target sensor 8 may preferably be maintained in a desired position with respect to the mechanical reference plane so that the positional relationship between the plasma generation region PS and the trajectory of the target material can be detected accurately and precisely.

Components of the chamber 1, such as the chamber wall 1*a*, may be heated by radiant heat from the plasma, scattered energy which has not been used to excite the target material, and so forth, to expand and deform. Accordingly, in a case where the target sensor 8 is supported by the chamber wall 1*a*, the position of the target sensor 8 may be shifted due to the deformation of the chamber wall 1*a*, and the trajectory of the target material may not be detected accurately and precisely. Thus, in the second embodiment, the target sensor 8 may be supported by the support frame 2.

In the second embodiment, the support frame 2 may be disposed outside the chamber 1. Thus, the support frame 2 may be less likely to be exposed directly to the radiant heat from the plasma, the scattered energy of the laser beam, and so forth. Accordingly, components of the support frame 2 may be less likely to be heated than the components of the chamber 1, such as the chamber wall 1*a*, and deformation of the support frame 2 due to thermal expansion may be suppressed. A coefficient of thermal expansion of components of the support frame 2 may be smaller than a coefficient of thermal expansion of components of the chamber 1, such as the chamber wall 1*a*. In that case, a deformation amount of the support frame 2 may be further smaller.

An fixing plate 81 of an XYZ stage 80 may be fixed to the support frame 2. The target sensor 8 may be fixed to a movable plate 82 of the XYZ stage 80. Accordingly, the position of the movable plate 82 may be adjusted with respect to the fixing plate 81 by the XYZ stage 80. The position of the target sensor 8 may thus be adjusted with respect to the support frame 2.

A holder 83*b* may be fixed to the support frame 2. A window frame 83*a* for supporting a window 83 transparent to light at a wavelength to be observed may be fixed to the holder 83*b*. The support frame 2 and the holder 83*b*, the holder 83*b* and the window frame 83*a*, and the window frame 83*a* and the window 83 may respectively be fixed to each other airtightly. The chamber wall 1*a* may have a through-hole 84 formed therein.

A flexible pipe 85 may be disposed so as to connect the chamber wall 1*a* and the window 83 outside the chamber 1. More specifically, the flexible pipe 85 may be connected, at one end thereof, airtightly to the chamber wall 1*a*, at the periphery of the through-hole 84 formed therein. The flexible pipe 85 may be connected, at the other end thereof, airtightly to the holder 83*b*, to which the window frame 83*a* of the window 83 is fixed. In this way, the flexible pipe 85 may be connected between the chamber wall 1*a*, at the periphery of the through-hole 84 formed therein, and the window 83, to seal the chamber 1. Further, the flexible pipe 85 may preferably be a pleated flexible pipe so as to stand the stress caused by a difference in pressure inside and outside the chamber 1. The target sensor 8 may be disposed outside the window 83, and may capture an image of the target material inside the chamber 1 through the window 83 and the through-hole 84.

Such configuration may allow the interior of the chamber 1 to be maintained at low pressure and the target sensor 8 to be held such that the position thereof can be adjusted by the XYZ stage 80. The target sensor 8 may be supported by the support frame 2 via the XYZ stage 80. Further, the support frame 2 may be less likely to be exposed directly to the radiant heat from the high-temperature plasma generated inside the chamber 1, and less likely to be heated than the components of the chamber 1, such as the chamber wall 1*a*, and thermal deformation in the support frame 2 may be suppressed. Accordingly, according to the second embodiment, the target sensor 8 can be supported by the support frame 2 to suppress the positional shift of the target sensor 8.

In the second embodiment, compared to a case where the window 83 and the XYZ stage 80 are fixed to the chamber wall 1*a*, the window 83 and the XYZ stage 80 may be less likely to deform or move due to heat. Accordingly, the detection accuracy and precision by the target sensor 8 may be improved.

In addition, as described above, in the second embodiment, the support frame 2 may be disposed outside the chamber 1 in its entirety. Accordingly, the chamber 1 need not be increased in size in order to reduce thermal deformation of the components of the chamber 1, such as the chamber wall 1*a*, which can reduce the chamber 1 in weight and in thickness. Accordingly, according to the second embodiment, the chamber 1 may be manufactured at a relatively low cost.

In the second embodiment as well, the support frame 2 may include a cooling mechanism to suppress thermal expansion of the support frame 2. Since the window 83 may be exposed to the low pressure atmosphere inside the chamber 1 via the space inside the flexible pipe 85, the window 83 may be heated by radiant heat from the plasma or scattered energy of the laser beam. The window 83 may be fixed to the support frame 2, and thus heat transferred to the window 83 may also be transferred to the support frame 2. Thus, the support frame 2 may be heated. Accordingly, a cooling mechanism including the cooling medium channel 6 may, for example, be provided in a portion of the support frame 2 to which the window 83 is fixed.

Third Embodiment

Figure 6:
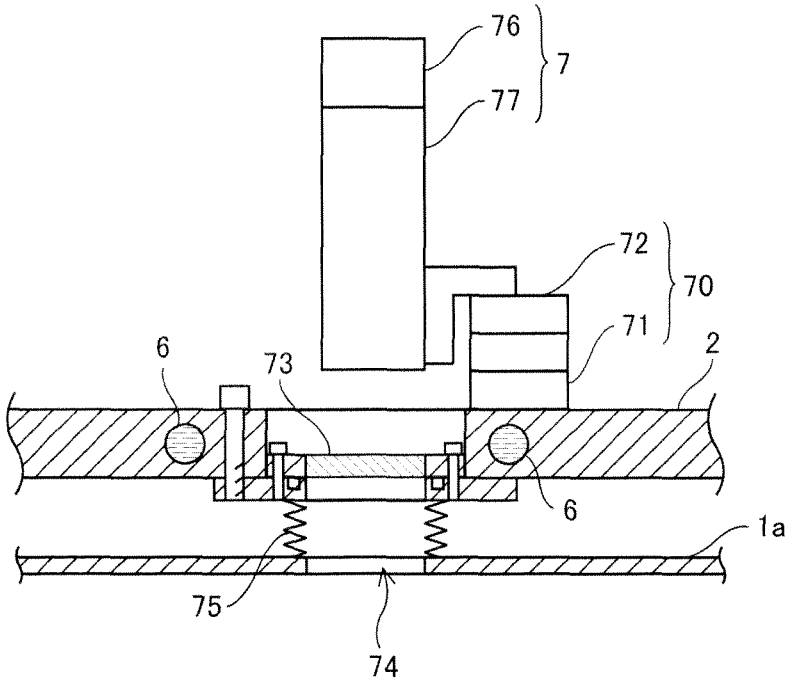
FIG. 6 is a sectional view illustrating the configuration for supporting an EUV light emission position sensor in an EUV light generation system according to a third embodiment of this disclosure.

FIG. 6 is a sectional view illustrating the configuration for supporting an EUV light emission position sensor in an EUV light generation system according to a third embodiment of this disclosure. The EUV light generation system according to the third embodiment may include an EUV light emission position sensor 7 for capturing the position of the plasma generation region PS inside the chamber 1. The system may have a plurality of EUV light emission position sensors 7. Other configurations may be similar to those of the first embodiment.

The EUV light emission position sensor 7 may include, for example, a CCD image sensor 76 and an optical system 77 including at least one lens, and may be configured to capture an image inside the chamber 1 and output image data. An image processing device to be provided separately may analyze and process the image data. Thus, the position of the plasma generation region PS at which the EUV light is generated may be detected by the image processing device. In a case where a plurality of EUV light emission position sensors 7 are used, the image processing device may detect the spatial position of the plasma generation region PS three-dimensionally from the plurality of the captured image data. The detection result may, for example, be fed back to control the six-axis stage 50 (See FIG. 2) described in the first embodiment. The position of the EUV collector mirror 4 may thus be controlled so that the first focus of the EUV collector mirror 4 corresponds to the plasma generation region PS. The configuration for supporting the EUV light emission position sensor 7 may be similar to the configuration for supporting the target sensor 8 described with reference to FIG. 5.

Fourth Embodiment

Figure 7:
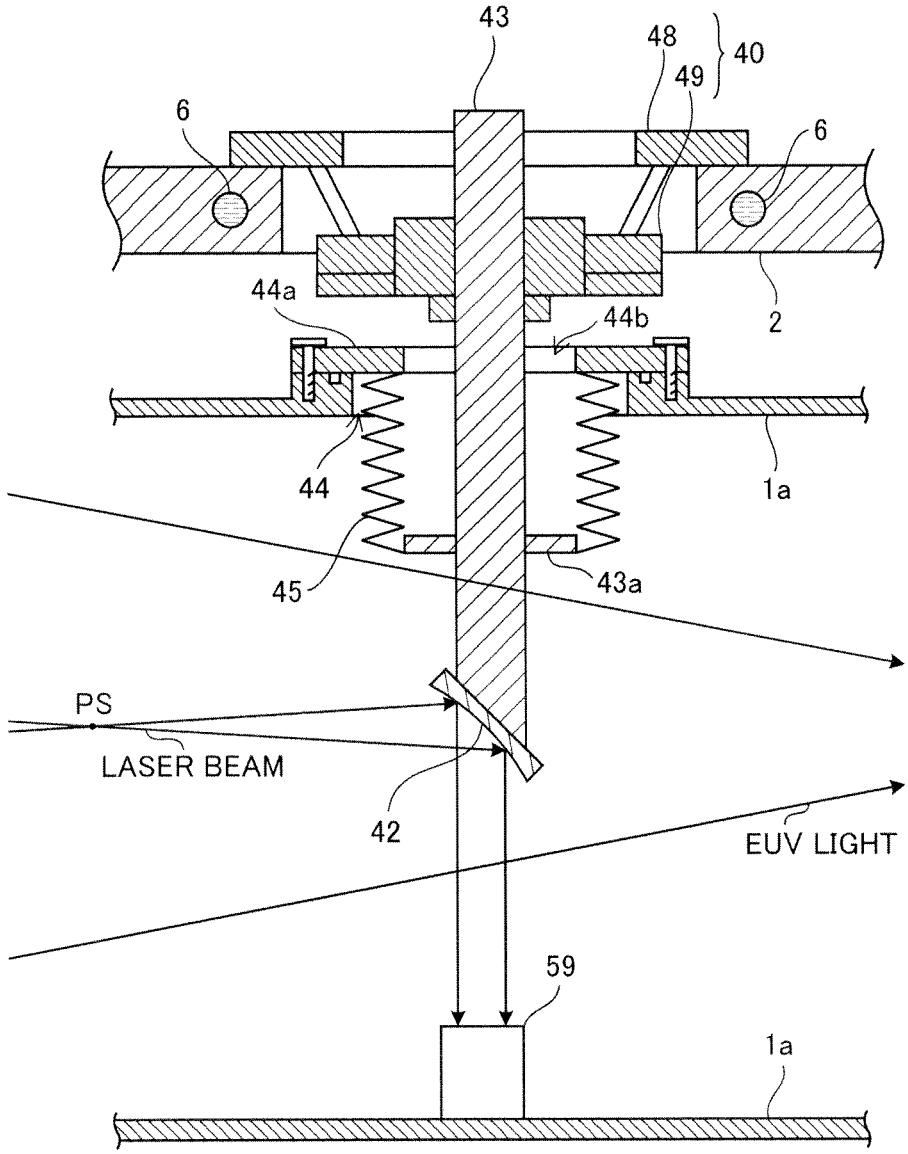
FIG. 7 is a sectional view illustrating the configuration for supporting a laser beam relay mirror in an EUV light generation system according to a fourth embodiment of this disclosure.

FIG. 7 is a sectional view illustrating the configuration for supporting an laser beam relay mirror in an EUV light generation system according to a fourth embodiment of this disclosure. The EUV light generation system according to the fourth embodiment may include a laser beam relay mirror 42 and a beam dump 59. The laser beam relay mirror 42 may reflect a laser beam introduced into the chamber 1 and having passed the plasma generation region PS. The beam dump 59 may be positioned to absorb the laser beam reflected by the laser beam relay mirror 42. Other configurations may be similar to those of the first embodiment.

In the fourth embodiment, the laser beam relay mirror 42 may be supported by the support frame 2. An fixing plate 48 of a six-axis stage 40 may be fixed to the support frame 2. A movable plate 49 of the six-axis stage 40 may be fixed to a support rod 43. The laser beam relay mirror 42 may be attached to the leading end of the support rod 43.

The chamber 1 may further include a chamber lid 44*a*. The chamber wall 1*a* may have an opening 44. The chamber lid 44*a* may be airtightly fixed to the chamber wall 1*a*, at the periphery of the opening 44, so as to seal the chamber 1. The chamber lid 44*a* may have a through-hole 44*b* in a region surrounded by a portion of the chamber lid 44*a* which is fixed to the chamber wall 1*a*. The support rod 43 may be inserted into the through-hole 44*b* of the chamber lid 44*a*. The support rod 43 may include a flange 43*a* disposed between a portion to which the movable plate 49 is fixed and a portion to which the laser beam relay mirror 42 is attached.

Inside the chamber 1, a flexible pipe 45 may be provided to connect the chamber wall 1*a* and the flange 43*a* of the support rod 43. More specifically, the flexible pipe 45 may be connected, at one end thereof, airtightly to the chamber lid 44*a*, at the periphery of the through-hole 44*b* formed in the chamber lid 44*a* fixed to the chamber wall 1*a*. Further, the flexible pipe 45 may be connected, at the other end thereof, airtightly to the flange 43*a* of the support rod 43. In this way, the flexible pipe 45 may connect the chamber lid 44*a*, at the periphery of the through-hole 44*b* formed therein, and the flange 43*a* of the support rod 43, to seal the chamber 1. Further, the flexible pipe 45 may preferably be a pleated flexible pipe so as to stand the stress caused by a difference in pressure inside and outside the chamber 1.

Fifth Embodiment

Figure 8:
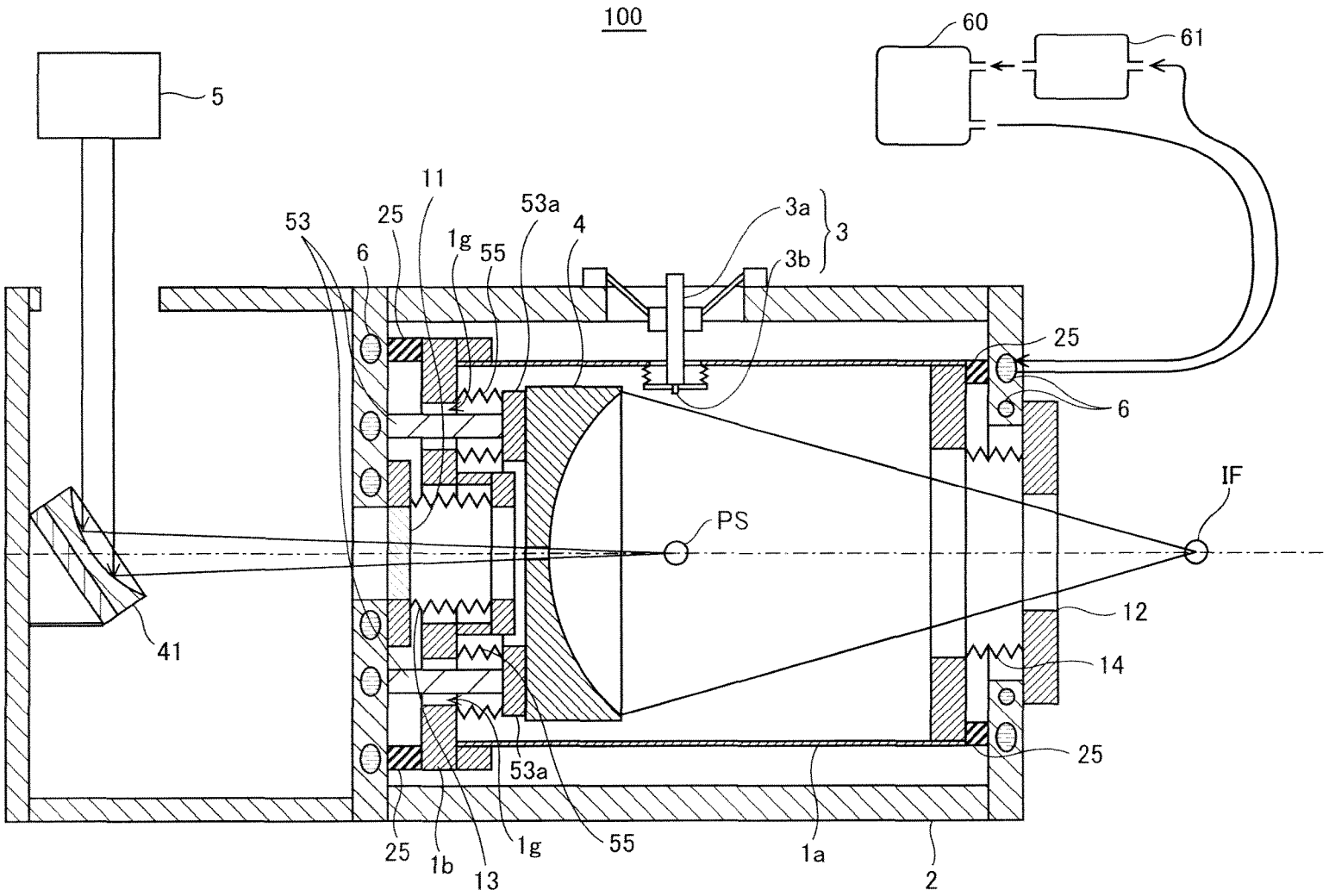
FIG. 8 is a sectional view schematically illustrating the configuration of an EUV light generation system according to a fifth embodiment of this disclosure.

FIG. 8 is a sectional view schematically illustrating the configuration of an EUV light generation system according to a fifth embodiment of this disclosure. The fifth embodiment may differ from the first embodiment in that the EUV collector mirror 4 is supported by having the mirror holder 53*a* fixed to the support frame 2 and the EUV light generation system 100 does not include the six-axis stage 50 (See FIG. 1). Other configurations may be similar to those of the first embodiment.

In the fifth embodiment, the EUV collector mirror 4 may be supported by a mirror holder 53*a*, and the mirror holder 53*a* may be fixed to a support rod 53. The support rod 53 may be directly fixed to the support frame 2. Accordingly, the positional relationship between the EUV collector mirror 4 and the support frame 2 can be maintained substantially constant. The position, the posture, and the like, of the EUV collector mirror 4 may be adjusted by adjusting the position, the posture, or the like, of the support frame 2 with respect to the mechanical reference plane.

As described in the first embodiment, the support rod 53 may be inserted into the through-hole 1*g* formed in the chamber wall 1*b*. Inside the chamber 1, a flexible pipe 55 may be disposed so as to connect the chamber wall 1*b*, at the periphery of the through-hole 1*g* formed therein, and the mirror holder 53*a*, to seal the chamber 1. In this way, the EUV collector mirror 4 and the chamber wall 1*b* may be connected to each other flexibly while maintaining airtightness of the chamber 1.

The fifth embodiment is directed to the EUV collector mirror 4 fixed to the support frame 2 via the mirror holder 53*a*, but this disclosure is not limited thereto. For example, the target supply unit 3, the EUV light emission position sensor 7, the target sensor 8, the laser beam relay mirror 42, and so forth, may be fixed directly to the support frame 2.

Sixth Embodiment

Figure 9:
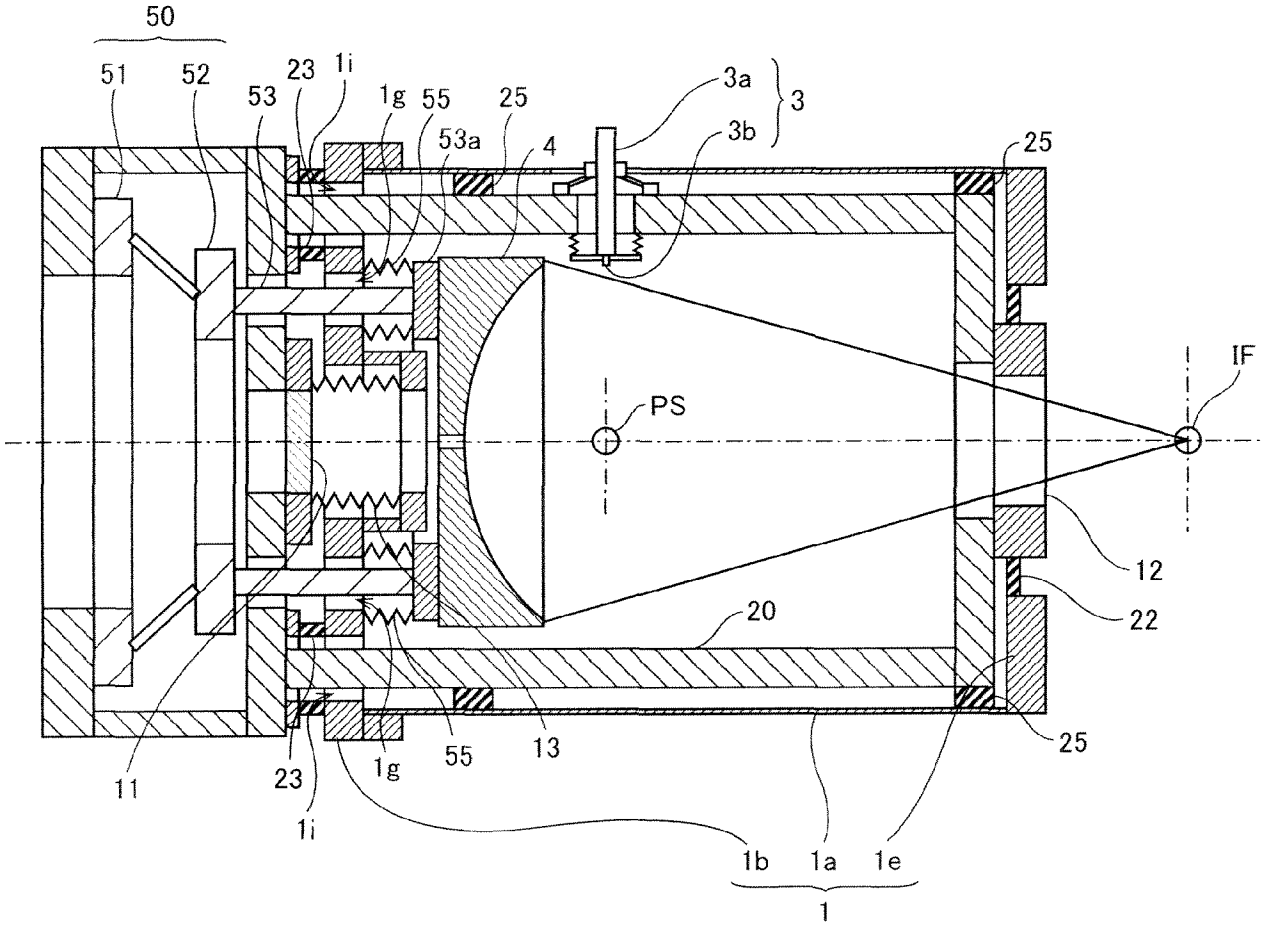
FIG. 9 is a sectional view schematically illustrating the configuration of an EUV light generation apparatus included in an EUV light generation system according to a sixth embodiment of this disclosure.

FIG. 9 is a sectional view schematically illustrating the configuration of an EUV light generation apparatus included in an EUV light generation system according to a sixth embodiment of this disclosure. An EUV light generation apparatus 90 may include the chamber 1, a support frame 20, the target supply unit 3, the EUV collector mirror 4, and so forth. The support frame 20 of the EUV light generation apparatus 90 may differ in configuration from the support frame 2 of the EUV light generation system 100 shown in FIG. 1. Further, the EUV light generation apparatus 90 may differ from the EUV light generation system 100 shown in FIG. 1 in that the EUV light generation apparatus 90 does not include the driver laser 5. Other configurations may be similar to those of the EUV light generation system 100 described with reference to FIG. 1.

In the EUV light generation apparatus 90, the target material inside the chamber 1 may be excited by excitation energy introduced from an external apparatus, such as the driver laser 5 to generate the EUV light. By combining the EUV light generation apparatus 90 with the driver laser 5, the EUV light generation system according to the sixth embodiment may be implemented.

In the EUV light generation apparatus 90, a through-hole 1*i* may be formed in the chamber wall 1*b*. A part of the support frame 20 may pass through the through-hole 1*i*. Since the part of the support frame 20 may be disposed inside the chamber 1, in the EUV light generation apparatus 90, the part of the support frame 20 may be heated inside the chamber 1.

However, in a case where a coefficient of thermal expansion of the components of the support frame 20 is smaller than a coefficient of thermal expansion of the components of the chamber 1, such as the chamber wall 1*a*, an amount of deformation of the support frame 20 may be small. Further, the part of the support frame 20, which is disposed outside the chamber 1, may be less likely to be exposed directly to radiant heat from the high-temperature plasma. Thermal deformation of such a part may thus be suppressed.

A tubular elastic member 23 may be disposed to connect the chamber wall 1*b* and the support frame 20 outside the chamber 1. More specifically, the tubular elastic member 23 may be connected, at one end thereof, airtightly to the chamber wall 1*b*, at the periphery of the through-hole 1*i* formed therein. The tubular elastic member 23 may be connected, at the other end thereof, airtightly to the support frame 20. In this way, the tubular elastic member 23 may connect the chamber wall 1*b*, at the periphery of the through-hole 1*i* formed therein, and the support frame 20, to seal the chamber 1. Accordingly, the support frame 20 and the chamber wall 1*b* may be connected to each other flexibly while maintaining airtightness of the chamber 1.

The chamber 1 may further include the connection 12 provided with an opening through which the EUV light generated inside the chamber 1 may be outputted to the processing apparatus such as the projection optical system in the exposure apparatus. The connection 12 may be connected to the chamber wall 1*e* via an elastic member 22.

Figure 10:
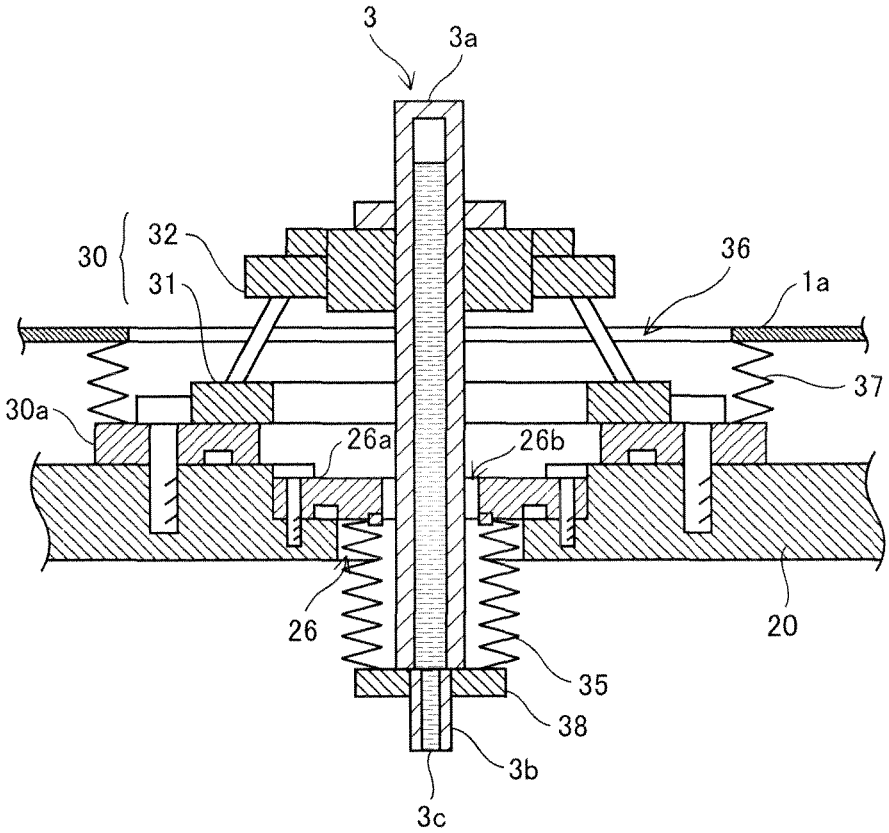
FIG. 10 is a sectional view illustrating the configuration for supporting a target supply unit in the EUV light generation system according to the sixth embodiment.

FIG. 10 is a sectional view illustrating the configuration for supporting the target supply unit in the EUV light generation system according to the sixth embodiment. As illustrated in FIG. 10, the target supply unit 3 may be supported by the support frame 20 at a portion disposed inside the chamber 1.

A through-hole 36 may be formed in the chamber wall 1*a*. An opening 26 may be formed in the support frame 20 at a portion disposed inside the chamber 1. A lid 26*a* may be fixed airtightly to the support frame 20 at the periphery of the opening 26. A through-hole 26*b* may be formed in the lid 26*a* in a region surrounded by the portion of the lid 26*a* fixed to the support frame 20. The target supply unit 3 may be inserted into the through-holes 36 and 26*b*.

A stage holder 30*a* may be fixed airtightly to the support frame 20 in a region surrounding the opening 26 on a side facing the through-hole 36. The fixing plate 31 of the six-axis stage 30 may be fixed to the stage holder 30*a*. The tank 3*a* of the target supply unit 3 may be fixed to the movable plate 32 of the six-axis stage 30. Accordingly, the position and the inclination of the movable plate 32 may be adjusted with respect to the fixing plate 31 by actuating the actuator of the six-axis stage 30. Accordingly, the position and the inclination of the target supply unit 3 may be adjusted with respect to the support frame 2.

A tubular elastic member 37 may be connected between the chamber wall 1*a* and the support frame 20 inside the chamber 1. More specifically, the tubular elastic member 37 may be connected, at one end thereof, airtightly to the chamber wall 1*a*, at the periphery of the through-hole 36 formed therein. The tubular elastic member 37 may be connected, at the other end thereof, airtightly to the stage holder 30*a*, at the periphery of the stage holder 30*a* fixed to the support frame 20. The tubular elastic member 37 may connect the chamber wall 1*a*, at the periphery of the through-hole 36 formed therein, and the support frame 20, to seal the chamber 1. Accordingly, the six-axis stage 30 for supporting the target supply unit 3 on the support frame 20 and the chamber wall 1*a* may be connected flexibly.

The target supply unit 3 may have the flange 38 provided between a portion at which the movable plate 32 is fixed to the tank 3*a* and the leading end of the nozzle 3*b*. The flexible pipe 35 may be disposed so as to connect the support frame 20 and the flange 38 of the target supply unit 3. More specifically, the flexible pipe 35 may be connected, at one end thereof, airtightly to the lid 26*a*, at the periphery of the through-hole 26*b* in the lid 26*a* fixed to the support frame 20. Further, the flexible pipe 35 may be connected, at the other end thereof, airtightly to the flange 38. In this way, the flexible pipe 35 may connect the lid 26*a*, at the periphery of the through-hole 26*b* formed therein, and the flange 38 of the target supply unit 3, to seal the chamber 1. Accordingly, the target supply unit 3 and the support frame 20 may be connected flexibly while maintaining airtightness of the chamber 1.

Such configuration may allow the interior of the chamber 1 to be maintained at low pressure and the target supply unit 3 to be held such that the position thereof can be adjusted by the six-axis stage 30. Further, since the target supply unit 3 is supported by the support frame 20 of a material with a small coefficient of thermal expansion, the positional shift of the target supply unit 3 may be suppressed.

Further, in the sixth embodiment, the six-axis stage 30 need not be shielded from the low pressure atmosphere inside the chamber 1. Accordingly, the six-axis stage 30 need not be treated for vacuum use, such as vaporization control of lubricant, which allows the six-axis stage 30 to be reduced in cost.

Referring again to FIG. 9, the configuration for supporting the EUV collector mirror 4 will be described. In the sixth embodiment, the EUV collector mirror 4 may be supported by a portion of the support frame 20 disposed outside the chamber 1. Thus, the positional shift of the EUV collector mirror 4 may be suppressed. In a case where a coefficient of thermal expansion of the components of the support frame 20 is small, the positional shift of the EUV collector mirror 4 may further be reduced. Other points may be similar to those of the configuration for supporting the EUV collector mirror 4 described with reference to FIG. 1.

Seventh Embodiment

Figure 11:
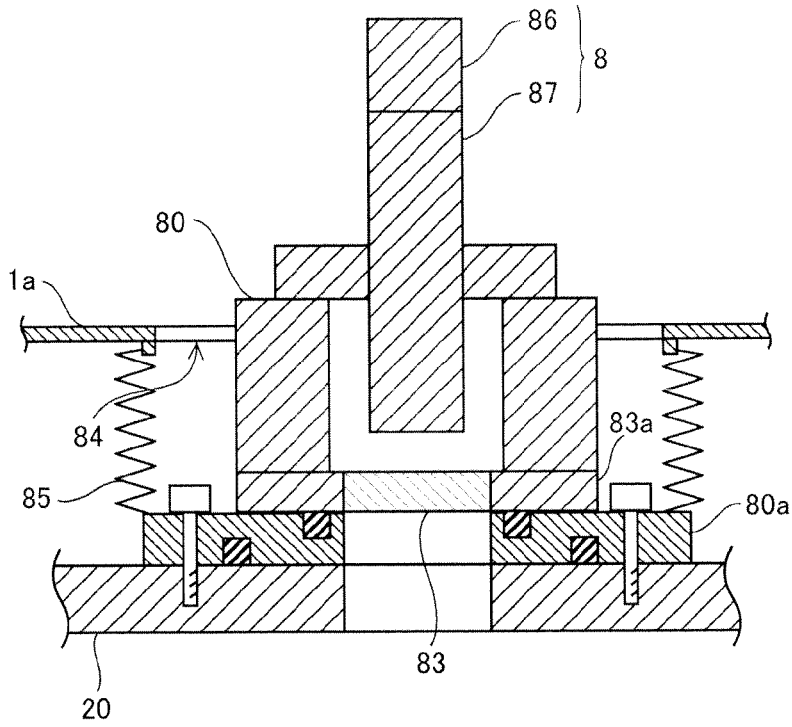
FIG. 11 is a sectional view illustrating the configuration of a target sensor in an EUV light generation system according to a seventh embodiment of this disclosure.

FIG. 11 is a sectional view illustrating the configuration for supporting a target sensor in an EUV light generation system according to a seventh embodiment of this disclosure. The EUV light generation system according to the seventh embodiment may include the target sensor 8 for capturing an image of the target material supplied into the chamber 1. Other configurations may be similar to those of the sixth embodiment. As illustrated in FIG. 11, the target sensor 8 may be supported by a portion of the support frame 20 disposed inside the chamber 1.

The target sensor 8 may include, for example, a CCD image sensor 86 and an optical system 87 including at least one lens, and may be configured to capture an image of the target material inside the chamber 1 and output image data. An image processing device to be provided separately may analyze and process the image data. A trajectory of the target material supplied into the chamber 1 and traveling thereinside may be detected by the mage processing device. In a case where a plurality of target sensors 8 are used, the image processing device may detect the spatial position of the trajectory of the target material three-dimensionally from the plurality of the captured image data. The detection result may, for example, be fed back to control the six-axis stage 30 (See FIG. 10) described in the sixth embodiment. Accordingly, the position of the target supply unit 3 may be controlled so that the target material is supplied precisely to the plasma generation region PS.

A through-hole 84 may be formed in the chamber wall 1*a*. A stage holder 80*a* may be fixed airtightly to the support frame 20 on a side facing the through-hole 84. The XYZ stage 80 may be fixed to the stage holder 80*a*. The target sensor 8 may be fixed to the XYZ stage 80. Accordingly, the position of the target sensor 8 may be adjusted with respect to the support frame 20 by actuating the XYZ stage 80.

The flexible pipe 85 may be disposed so as to connect the chamber wall 1*a* and the support frame 20 inside the chamber 1. More specifically, the flexible pipe 85 may be fixed, at one end thereof, airtightly to the chamber wall 1*a*, at the periphery of the through-hole 84 formed therein. The flexible pipe 85 may be fixed, at the other end thereof, airtightly to the stage holder 80*a*, at the periphery of the stage holder 80*a* fixed to the support frame 20. The flexible pipe 85 may connect the chamber wall 1*a*, at the periphery of the through-hole 84 formed therein, and the support frame 20, to seal the chamber 1. The XYZ stage 80 for supporting the target sensor 8 on the support frame 20 and the chamber wall 1*a* may be connected to each other flexibly.

The window frame 83*a* for supporting the window 83 transparent to light at a wavelength to be observed may be fixed to the stage holder 80*a* fixed to the support frame 20. The target sensor 8 may be disposed outside the window 83 and may capture an image of the target material inside the chamber 1 through the window 83. Such configuration may allow the interior of the chamber 1 to be maintained at low pressure and the target sensor 8 to be held such that the position thereof can be adjusted by the XYZ stage 80. Further, the target sensor 8 and the XYZ stage 80 may be less likely to be exposed directly to the radiant heat from the high-temperature plasma generated inside the chamber 1. Thermal deformation therein may be suppressed.

Further, according to the seventh embodiment, since the target sensor 8 may be supported by the support frame 20 of a material with a small coefficient of thermal expansion, the positional shift of the target sensor 8 can be suppressed.

Furthermore, in the seventh embodiment, compared to a case where the window 83 and the XYZ stage 80 are fixed to the chamber wall 1*a*, the window 83 and the XYZ stage 80 may be less likely to deform or move due to heat. Accordingly, the detection accuracy and precision by the target sensor 8 may be improved.

Eighth Embodiment

Figure 12:
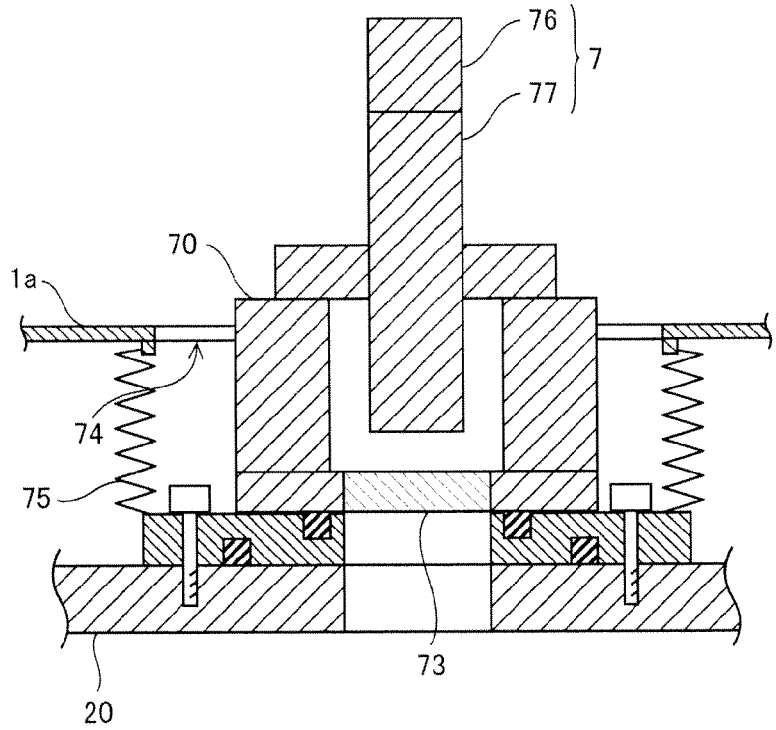
FIG. 12 is a sectional view illustrating the configuration of an EUV light emission position sensor in an EUV light generation system according to an eighth embodiment of this disclosure.

FIG. 12 is a sectional view illustrating the configuration for supporting an EUV light emission position sensor in an EUV light generation system according to an eighth embodiment of this disclosure. The EUV light generation system according to the eighth embodiment may include the EUV light emission position sensor 7 for capturing an image of the plasma generation region PS inside the chamber 1. A plurality of EUV light emission position sensors 7 may be employed. Other configuration may be similar to those of the sixth embodiment.

The EUV light emission position sensor 7 may include, for example, a CCD image sensor 76 and an optical system 77 including at least one lens, and may be configured to capture an image inside the chamber 1 and output image data. An image processing device to be provided separately may analyze and process the image data. Thus, a position of the plasma generation region PS in which the EUV light is generated may be detected by the mage processing device. In a case where the plurality of EUV light emission position sensors 7 are used, the image processing device may detect the spatial position of the plasma generation region PS three-dimensionally from the plurality of the captured image data. The detection result may, for example, be fed back to control the six-axis stage 50 (See FIG. 9). The position of the EUV collector mirror 4 may be controlled so that the first focus of the EUV collector mirror 4 corresponds to the plasma generation region PS. The configuration for supporting the EUV light emission position sensor 7 may be similar to the configuration for supporting the target sensor 8 described with reference to FIG. 11.

Ninth Embodiment

Figure 13:
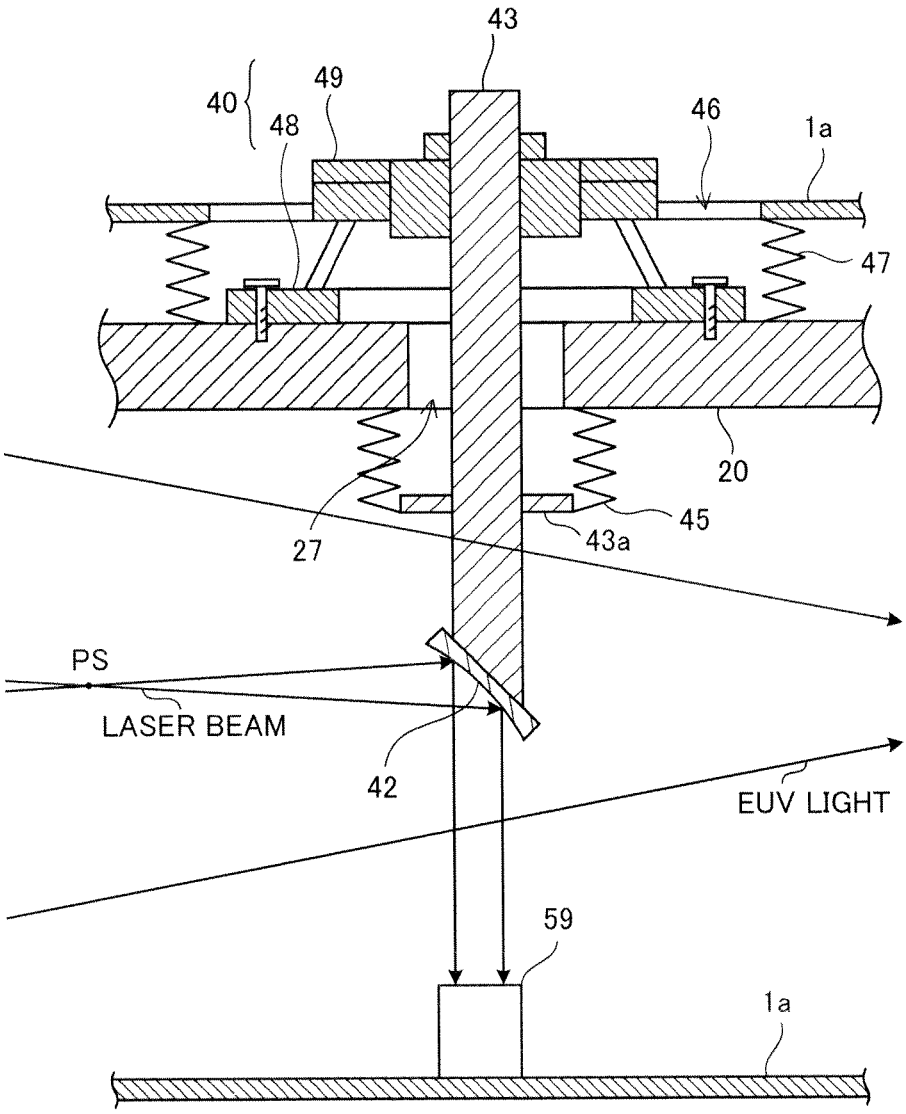
FIG. 13 is a sectional view illustrating the configuration for supporting a laser beam relay mirror in an EUV light generation system according to a ninth embodiment of this disclosure.

FIG. 13 is a sectional view illustrating the configuration for supporting a laser beam relay mirror in an EUV light generation system according to a ninth embodiment of this disclosure. The EUV light generation system according to the ninth embodiment may include the laser beam relay mirror 42 and the beam dump 59. The laser beam relay mirror 42 may reflect the laser beam having passed the plasma generation region PS. The beam dump 59 may be positioned to absorb the laser beam reflected by the laser beam relay mirror 42. Other configurations may be similar to those of the sixth embodiment.

As illustrated in FIG. 13, the laser beam relay mirror 42 may be supported by a portion of the support frame 20 disposed inside the chamber 1. A through-hole 46 may be formed in the chamber wall 1*a*. A through-hole 27 may be formed in the support frame 20 at a portion inside the chamber 1. The support rod 43 for supporting the laser beam relay mirror 42 may be inserted into the through-holes 46 and 27.

An fixing plate 48 of the six-axis stage 40 may be fixed to the support frame 20 in a region surrounding the through-hole 27 on a side facing the through-hole 46. A movable plate 49 of the six-axis stage 40 may be fixed to the support rod 43. The laser beam relay mirror 42 may be attached at the leading end of the support rod 43.

A tubular elastic member 47 may be disposed so as to connect the chamber wall 1*a* and the support frame 20. More specifically, the tubular elastic member 47 may be connected, at one end thereof, airtightly to the chamber wall 1*a*, at the periphery of the through-hole 46 formed therein. The tubular elastic member 47 may be connected, at the other end thereof, airtightly to the support frame 20, at the periphery of a portion to which the six-axis stage 40 is fixed. Accordingly, the tubular elastic member 47 may connect the chamber wall 1*a*, at the periphery of the through-hole 46 formed therein, and the support frame 20, to seal the chamber 1.

The support rod 43 may have a flange 43*a* provided between a portion to which the movable plate 49 is fixed and a portion to which the laser beam relay mirror 42 is fixed. The flexible pipe 45 may be connected between the support frame 20 and the flange 43*a* of the support rod 43. More specifically, the flexible pipe 45 may be connected, at one end thereof, airtightly to the support frame 20, at the periphery of the through-hole 27 formed therein. The flexible pipe 45 may be connected, at the other end thereof, airtightly to the flange 43*a* of the support rod 43. Accordingly, the flexible pipe 45 may connect the support frame 20, at the periphery of the through-hole 27 formed therein, and the flange 43*a* of the support rod 43, to seal the chamber 1.

Tenth Embodiment

Figure 14:
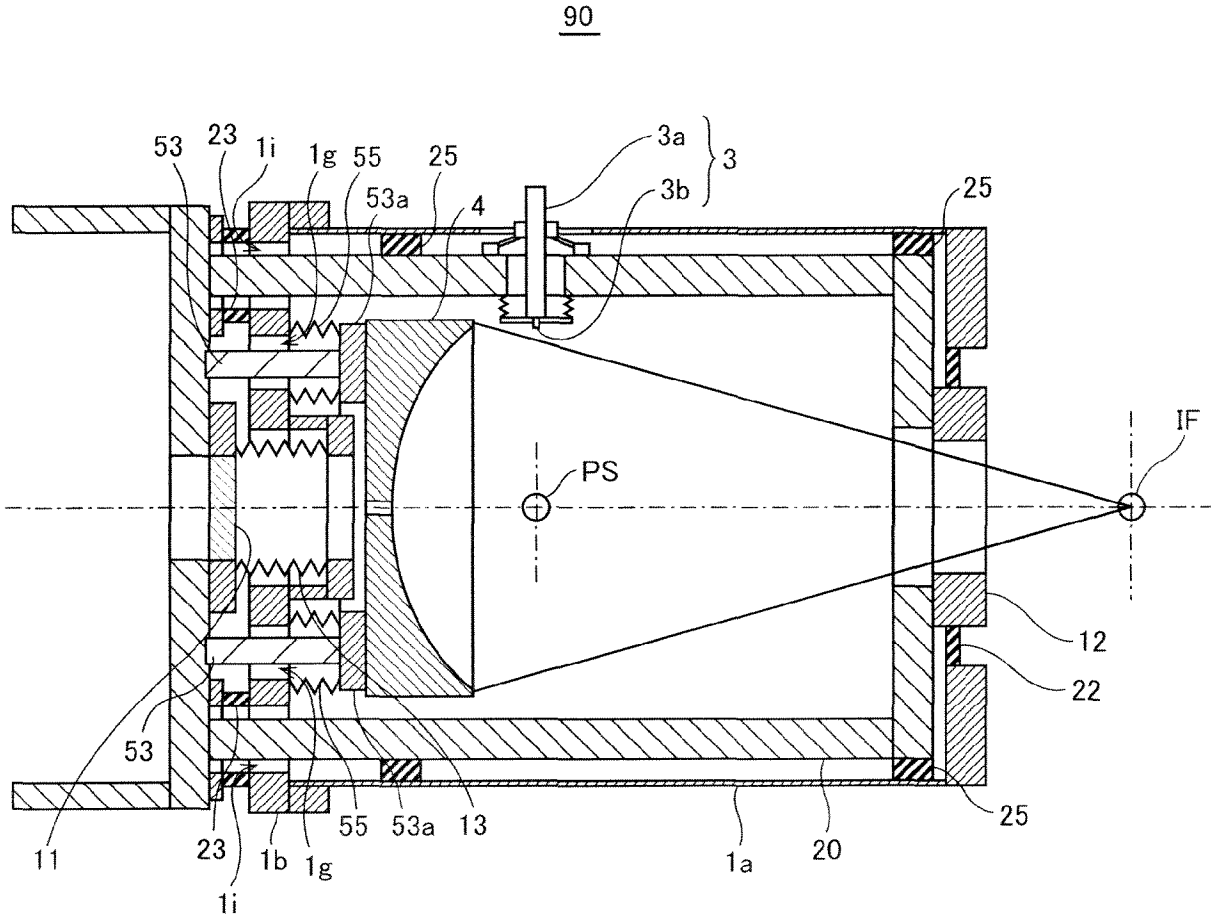
FIG. 14 is a sectional view schematically illustrating the configuration of an EUV light generation apparatus included in an EUV light generation system according to a tenth embodiment of this disclosure.

FIG. 14 is sectional view schematically illustrating the configuration of an EUV light generation apparatus included in an EUV light generation system according to a tenth embodiment of this disclosure. The tenth embodiment may differ from the sixth embodiment in that the EUV collector mirror 4 is supported by having the mirror holder 53*a* fixed to the support frame 20 and the EUV light generation apparatus 90 does not include the six-axis stage 50 (See FIG. 9). Other configurations may be similar to those of the sixth embodiment.

In the tenth embodiment, the EUV collector mirror 4 may be supported by the mirror holder 53*a*, and the mirror holder 53*a* may be fixed to the support rod 53. The support rod 53 may be fixed directly to the support frame 20. Accordingly, the positional relationship between the EUV collector mirror 4 and the support frame 20 may be maintained substantially constant. The position, the inclination, or the like, of the EUV collector mirror 4 may be adjusted by adjusting the position, the inclination, or the like, of the support frame 20 with respect to the mechanical reference plane.

As described in the sixth embodiment, the support rod 53 may be inserted into the through-hole 1*g* formed in the chamber wall 1*b*. The flexible pipe 55 may be disposed so as to connect the chamber wall 1*b*, at the periphery of the through-hole 1*g* formed therein, and the mirror holder 53*a*, to seal the chamber 1. The EUV collector mirror 4 and the chamber wall 1*b* may be connected to each other flexibly while maintaining airtightness of the chamber 1.

The tenth embodiment is directed to the EUV collector mirror fixed to the support frame 20 via the mirror holder 53*a*, but this disclosure is not limited thereto. For example, the target supply unit 3, the EUV light emission position sensor 7, the target sensor 8, the laser beam relay mirror 42, and so forth, can be fixed directly to the support frame 20.

Eleventh Embodiment

Figure 15:
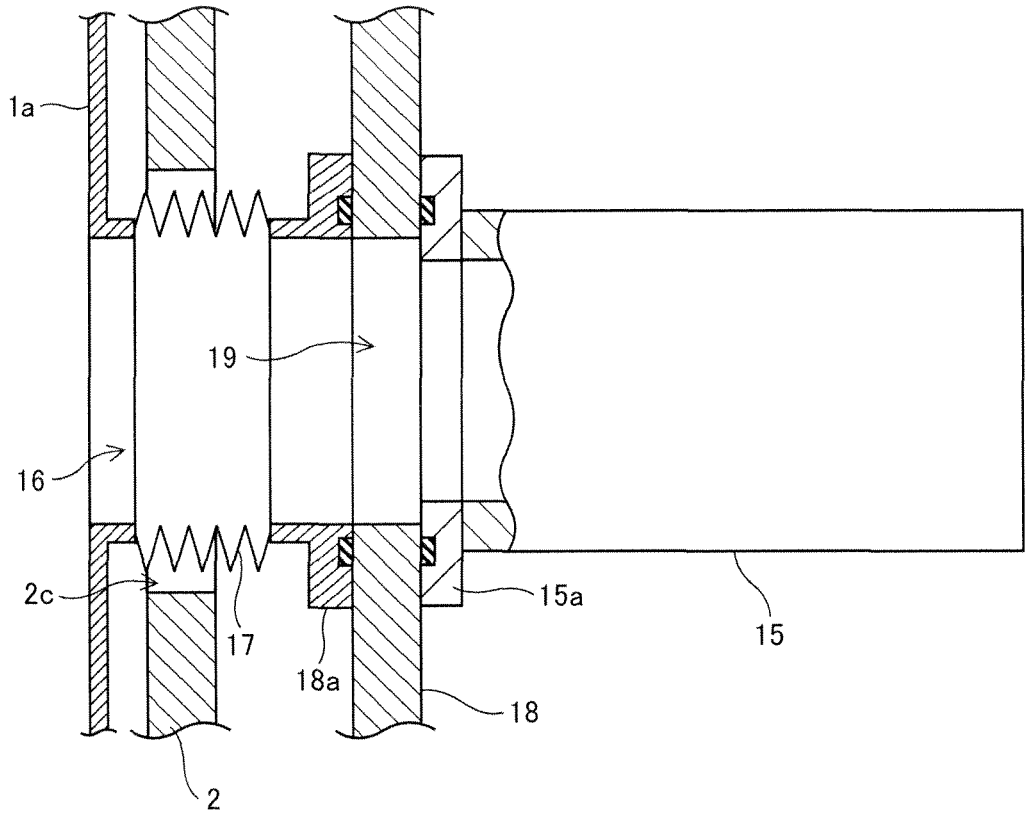
FIG. 15 is a partial sectional view illustrating the configuration for supporting a vacuum pump in an EUV light generation system according to an eleventh embodiment of this disclosure.

FIG. 15 is a partial sectional view illustrating the configuration for supporting a vacuum pump in an EUV light generation system according to an eleventh embodiment of this disclosure. The EUV light generation system according to the eleventh embodiment may include a vacuum pump 15 for exhausting the chamber 1. Other configurations may be similar to those of the first embodiment.

A turbo molecular pump, for example, may be used as the vacuum pump 15. The turbo molecular pump may include a rotor for rotating at high speed and blowing away gas molecules to exhaust the gas. When the vacuum pump 15 is actuated, vibration may be generated due to the rotor rotating as described above. In a case where the vibration of the vacuum pump 15 is transmitted to the support frame 2, the support frame 2 may be vibrated. Thus, the EUV collector mirror 4 (See FIG. 1), the target supply unit 3 (See FIG. 2), the target sensor 8 (See FIG. 5), the EUV light emission position sensor 7 (See FIG. 6), and so forth, may also be vibrated. Further, in a case where the vibration of the vacuum pump 15 is transmitted to the chamber wall 1*a*, in addition to the stress caused by the difference in pressure inside and outside the chamber 1, stress due to the vibration may be added to the chamber 1, and thus the chamber 1 may need to have increased strength.

Accordingly, in the eleventh embodiment, the vacuum pump 15 may be supported by a second support frame 18. Thus, the vibration generated at the vacuum pump 15 may be prevented from being transmitted directly to the support frame 2.

A through-hole 16 may be formed in the chamber wall 1*a*, and a through-hole 19 may be formed in the second support frame 18. An annular member 18*a* may be connected to the second support frame 18, at the periphery of the through-hole 19, on one side facing the chamber 1. An intake port 15*a* of the vacuum pump 15 may be connected to the second support frame 18, at the periphery of the through-hole 19, on the other side of the second support frame 18.

A flexible pipe 17 may be disposed so as to connect the chamber wall 1*a* and the second support frame 18 outside the chamber 1. More specifically, the flexible pipe 17 may be connected, at one end thereof, airtightly to the chamber wall 1*a*, at the periphery of the through-hole 16 formed therein. The flexible pipe 17 may be connected, at the other end thereof, airtightly to the annular member 18*a* fixed to the second support frame 18 at the periphery of the through-hole 19. In this way, the interior of the chamber 1 and the intake port 15*a* of the vacuum pump 15 may be in communication via the through-hole 16. The flexible pipe 17 may be inserted into the through-hole 2*c* formed in the support frame 2. Further, the flexible pipe 17 may preferably be a pleated flexible pipe so as to stand the stress caused by a difference in pressure inside and outside the chamber 1. Thus, the vibration generated at the vacuum pump 15 may be prevented from being transmitted directly to the chamber wall 1*a*.

In the eleventh embodiment, the case where the support frame 2 is disposed outside the chamber 1 has been described; however, the part of the support frame 2 may be disposed inside the chamber 1.

Twelfth Embodiment

Figure 16:
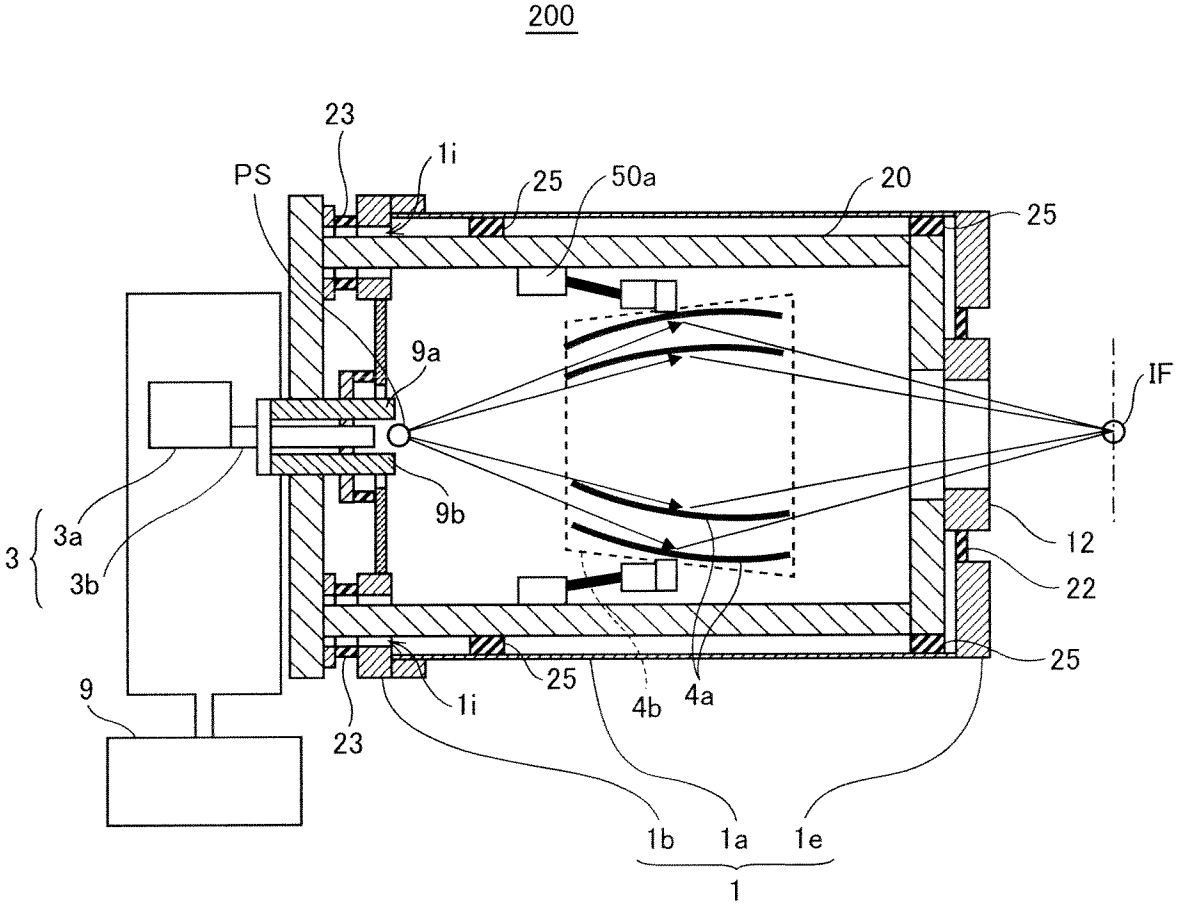
FIG. 16 is a sectional view schematically illustrating the configuration of an EUV light generation apparatus according to a twelfth embodiment of this disclosure.

FIG. 16 is a sectional view schematically illustrating an EUV light generation apparatus according to a twelfth embodiment of this disclosure. An EUV light generation apparatus 200 may be a DPP type apparatus, in which an electric discharge is generated between electrodes to excite a target material so that the EUV light is generated. The DPP method may be advantageous in that the EUV light generation apparatus can be reduced in size and in power consumption. The EUV light generation apparatus 200 may include a chamber 1, a support frame 20, a target supply unit 3, an EUV collector mirror 4*a*, and a pair of electrodes 9*a* and 9*b*.

The chamber 1 may define a space thereinside in which the EUV light is generated. The interior of the chamber 1 may be maintained at pressure lower than atmospheric pressure. Further, the chamber 1 may include a connection 12 having an opening through which the EUV light generated inside the chamber 1 is outputted to a processing apparatus such as a projection optical system of an exposure apparatus. The connection 12 may be connected to a chamber wall 1*e* via an elastic member 22.

A support frame 20 may be positioned precisely with respect to the mechanical reference plane, and may function to support the target supply unit 3, the EUV collector mirror 4*a*, and so forth, at predetermined positions, respectively. The support frame 20 may be fixed to the connection 12. Further, the support frame 20 may be connected to the chamber wall 1*a* flexibly via an elastic member 25.

Further, in the twelfth embodiment, a through-hole 1*i* may be formed in the chamber wall 1*b*. Part of the support frame 20 may pass through the through-hole 1*i*, whereby part of the support frame 20 may be disposed inside the chamber 1.

A tubular elastic member 23 may be connected between the chamber wall 1*b* and the support frame 20 outside the chamber 1. More specifically, the tubular elastic member 23 may be connected, at one end thereof, airtightly to the chamber wall 1*b*, at the periphery of the through-hole 1*i* formed therein. The tubular elastic member 23 may be connected, at the other end thereof, airtightly to the support frame 20. The tubular elastic member 23 may connect the chamber wall 1*b*, at the periphery of the through-hole 1*i* formed therein, and the support frame 20, to seal the chamber 1. Accordingly, the support frame 20 and the chamber wall 1*b* may be connected to each other flexibly while maintaining airtightness of the chamber 1.

The target supply unit 3 may be configured to supply a target material, such as xenon (Xe) gas, lithium (Li) vapor, tin (Sn) vapor, or the like, into a space between the pair of the electrodes 9*a* and 9*b* inside the chamber 1. The target supply unit 3 may include a tank 3*a* for storing the target material thereinside and a nozzle 3*b* through which the target material inside the tank 3*a* is outputted into the chamber 1.

The pair of the electrodes 9*a* and 9*b* may be disposed inside the chamber 1. The pair of the electrodes 9*a* and 9*b* may be connected to a high-voltage pulse generation unit 9. Alternatively, one of the pair of the electrodes 9*a* and 9*b* may be connected to the high-voltage pulse generation unit 9 and the other may be connected to a predetermined potential (ground potential, for example). When a high-voltage pulse is generated by the high-voltage pulse generation unit 9, an electric discharge may occur between the pair of the electrodes 9*a* and 9*b*. The target material supplied into a space between the pair of the electrodes 9*a* and 9*b* may be excited by the electric discharge and thus be turned into plasma. Rays of light at various wavelengths, including the EUV light, may be emitted from this plasma.

The EUV collector mirror 4*a* may be disposed inside the chamber 1. The EUV collector mirror 4*a* may include a plurality of ellipsoidal reflective surfaces, of which the diameters may differ respectively. The EUV collector mirror 4*a* may be configured such that a metal, such as ruthenium (Ru), molybdenum (Mo), and rhodium (Rd), is coated on a surface to serve as a reflective surface on a base material having a smooth surface. The base material includes, but not limited to, nickel (Ni). The EUV collector mirror 4*a* may reflect the EUV light incident thereon at an angle of 0 to 25 degrees with high reflectivity.

The EUV collector mirror 4*a* may be disposed such that the first focus of the ellipsoidal reflective surface thereof corresponds to the plasma generation region PS. The EUV light reflected by the EUV collector mirror 4*a* may be focused on the second focus of the ellipsoidal reflective surface thereof, that is, the intermediate focus IF. Then, the EUV light may be outputted to the processing apparatus, such as the projection optical system in the exposure apparatus, connected to the chamber 1.

In the twelfth embodiment as well, the EUV collector mirror 4*a* and the target supply unit 3 may be supported by the support frame 20. Further, a target sensor, an EUV light emission position sensor, and so forth, as in those described with reference to FIGS. 11 and 12, may be supported by the support frame 20.

For example, the EUV collector mirror 4*a* may be supported by the support frame 20 at a portion inside the chamber 1. An EUV collector mirror stage 50*a* may be fixed to the support frame 20, an EUV collector mirror holder 4*b* may be fixed to the EUV collector mirror stage 50*a*, and the EUV collector mirror 4*a* may be fixed to the EUV collector mirror holder 4*b*. Thus, the position and the inclination of the EUV collector mirror 4*a* may be adjusted with respect to the support frame 20 by actuating the actuator of the EUV collector mirror stage 50*a*.

In the twelfth embodiment, the case where a part of the support frame 20 is disposed inside the chamber 1 has been described, but, without being limited thereto, the support frame 20 may be disposed outside the chamber 1 in its entirety.

The configuration for supporting the target supply unit 3 may be similar to those described with reference to FIGS. 2 and 10. The configurations for supporting the target sensor, the EUV light emission position sensor, and so forth, may be similar to those described with reference to FIGS. 5, 6, 11, and 12, respectively.

Thirteenth Embodiment

Figure 17:
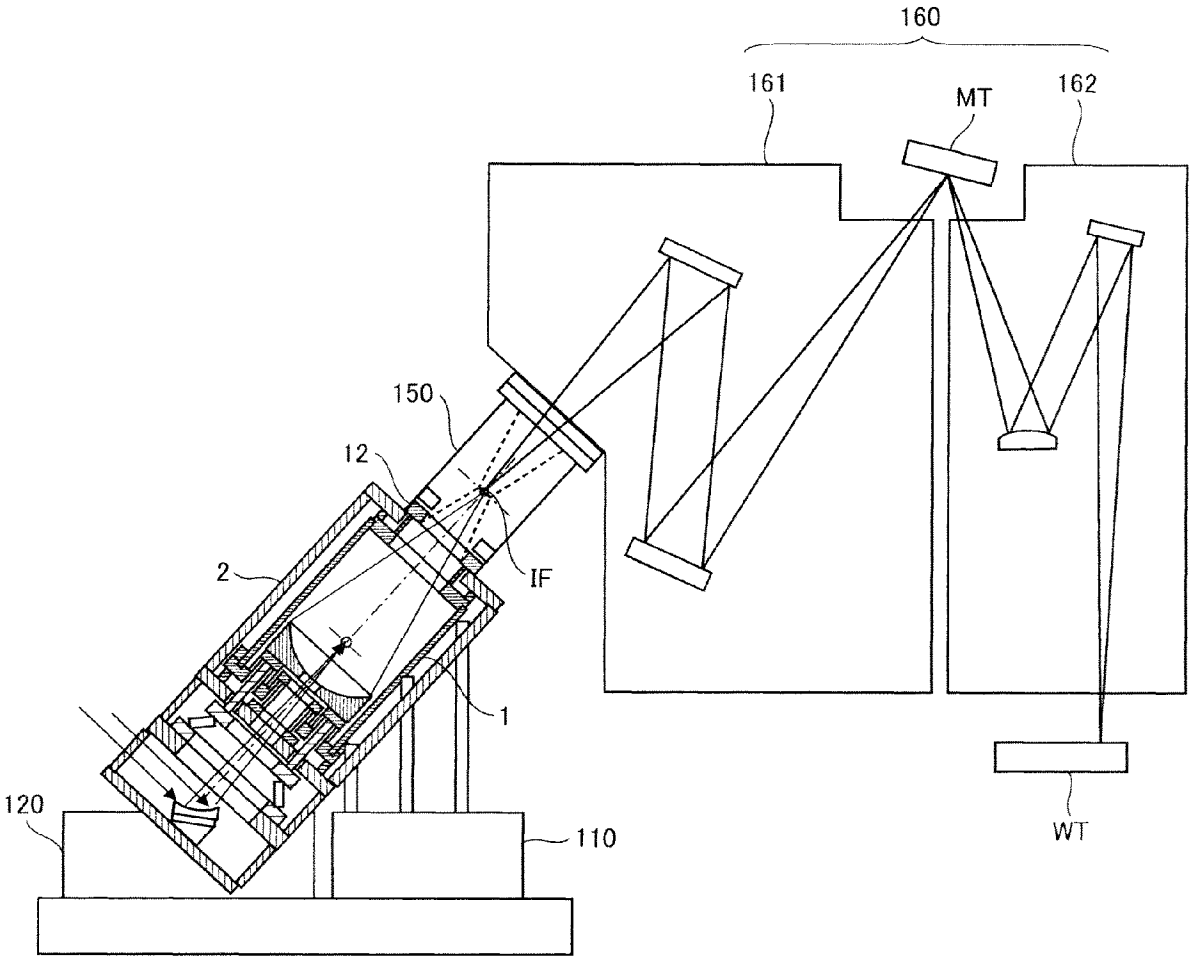
FIG. 17 is a side view illustrating an example in which an EUV light generation system according to a thirteenth embodiment is connected to a projection optical system of an exposure apparatus.

FIG. 17 is a side view illustrating an EUV light generation system according to a thirteenth embodiment being connected to a projection optical system of an exposure apparatus. The EUV light generation system according to any of the first through twelfth embodiments may be employed as the EUV light generation system according to the thirteenth embodiment. In the thirteenth embodiment, the chamber 1 constituting the EUV light generation system may be supported by a chamber support stand 110. The chamber support stand 110 may preferably support the chamber 1 such that even in a case where the chamber 1 deforms and moves due to thermal expansion or the like, the stress caused by the deformation and the movement is not transferred to the support frame 2. The support frame 2 constituting the EUV light generation system may be supported by a frame support stand 120 independent of the chamber support stand 110. The frame support stand 120 may include position/inclination adjustment mechanism for adjusting the position and the inclination of the support frame 2 to a desired position and a desired inclination, respectively, with respect to the mechanical reference plane. Further, the frame support stand 120 may include a position/inclination fixing mechanism for fixedly supporting the support frame 2 in the adjusted position and at the adjusted inclination. The mechanical reference plane may be set to a part of the processing apparatus, to an installation floor surface, or to another apparatus disposed around the chamber 1.

A projection optical system 160 may be an example of a processing apparatus in which the EUV light is used for processing, and may include a mask irradiation unit 161, which is an optical system for irradiating the mask with the EUV light, and a workpiece irradiation unit 162, which is an optical system for projecting an image of the mask onto a wafer. The mask irradiation unit 161 may allow a mask pattern on a mask table MT to be irradiated with the EUV light introduced thereinto from the chamber 1 of the EUV light generation system via a reflective optical system. The workpiece irradiation unit 162 may allow the EUV light reflected by the mask table MT to be imaged on a workpiece (semiconductor wafer, for example) on a workpiece table WT via a reflective optical system. By transitionally moving the mask table MT and the workpiece table WT simultaneously, the projection optical system 160 may allow the mask pattern to be transferred onto the workpiece. The mechanical reference plane may be set to part of an element constituting the projection optical system.

An optical path connection module 150 may be connected, at one end thereof, to the connection 12 of the chamber 1, and, at the other end thereof, to the mask irradiation unit 161. The optical path connection module 150 may define a path of the EUV light between the chamber 1 and the mask irradiation unit 161 and isolate the path of the EUV light from the outside. The intermediate focus IF may lie in the optical path connection module 150.

With the above configuration, the EUV light generation system including the chamber 1 and the support frame 2 may be connected to the projection optical system 160 of the exposure apparatus. The mechanical reference plane may be set on the mask irradiation unit 161 to which the optical path connection module 150 is connected. The mechanical reference plane may be set to a part of the optical path connection module 150. For example, the mechanical reference plane may be the connection plane of the optical path connection module 150 and the mask irradiation unit 161. Alternatively, the mechanical reference plane may be the connection plane of the optical path connection module 150 and the connection 12.

In the above description, the elastic members 23 and 25 may exemplarily correspond to a first connection member for connecting a frame and a chamber flexibly. The flexible pipe 35 may exemplarily correspond to a second connection member for connecting a target supply unit to a chamber flexibly. The flexible pipe 55 may exemplarily correspond to a third connection member for connecting a chamber, at the periphery of a through-hole formed therein, and an fixing member flexibly and closing off the chamber. The flexible pipe 17 may exemplarily correspond to a fourth connection member for connecting the chamber and a vacuum pump.

The above-described embodiments and the modifications thereof are merely examples for implementing this disclosure, and this disclosure is not limited thereto. Making various modifications according to the specifications or the like falls within the scope of this disclosure, and it is apparent from the above description that other various embodiments are possible within the scope of this disclosure. For example, it goes without saying that the modifications illustrated for each of the embodiments can be applied to other embodiments as well.

The terms used in this specification and the appended claims should be interpreted as "non-limiting." For example, the terms "include" and "be included" should be interpreted as "not limited to the stated elements." The term "have" should be interpreted as "not limited to the stated elements." Further, the modifier "one (a/an)" should be interpreted as at least one or "one or more."

What is claimed is:

1. An apparatus for generating extreme ultraviolet light by exciting a target material to turn the target material into plasma, the apparatus comprising:

a frame;

a chamber in which the extreme ultraviolet light is generated and in which a through-hole is formed;

a target supply unit inserted through the through-hole and configured for supplying the target material into the chamber;

a first connection member configured for connecting the frame and the chamber flexibly;

a mechanism configured for fixing the target supply unit to the frame; and a second connection member for flexibly connecting the chamber, at the periphery of the through-hole, and the target supply unit, to seal the chamber, the second connection member being a flexible pipe.

2. The apparatus according to claim 1, wherein a coefficient of thermal expansion of at least one member of the frame is smaller than a coefficient of thermal expansion of at least one member of the chamber.

3. The apparatus according to claim 1, wherein the first connection member is an elastic member.

4. The apparatus according to claim 1, wherein at least a part of the frame is disposed outside the chamber.

5. The apparatus according to claim 1, further comprising a vacuum pump connected to the chamber via a fourth connection member, the fourth connection member being a flexible pipe.

6. An apparatus for generating extreme ultraviolet light by exciting a target material to turn the target material into plasma, the apparatus comprising:

a frame to which a window is fixed;

a chamber in which the extreme ultraviolet light is generated and in which a through-hole is formed;

a target sensor for detecting, through the window, a trajectory of the target material supplied into the chamber;

a first connection member configured for connecting the frame and the chamber flexibly;

a mechanism configured for fixing the target sensor to the frame; and a second connection member for flexibly connecting the chamber, at the periphery of the through-hole, and the frame, at the periphery of the window, to seal the chamber, the second connection member being a flexible pipe.

7. An apparatus for generating extreme ultraviolet light by exciting a target material to turn the target material into plasma, the apparatus comprising:

a frame a chamber in which the extreme ultraviolet light is generated and in which a through-hole is formed;

a collector mirror, disposed inside the chamber, for collecting the extreme ultraviolet light generated inside the chamber;

a first connection member configure for connecting the frame and the chamber flexibly;

a fixing member, inserted through the through-hole, for fixing the collector mirror to the frame; and a second connection member for flexibly connecting the chamber, at the periphery of the through-hole, and the fixing member, to seal the chamber, the second connection member being a flexible pipe.

8. An apparatus for generating extreme ultraviolet light by exciting a target material to turn the target material into plasma, the apparatus comprising:

a frame to which a window is fixed;

a chamber in which the extreme ultraviolet light is generated and in which a through-hole is formed;

an extreme ultraviolet light emission position sensor for detecting, through the window, energy of the extreme ultraviolet light generated inside the chamber;

a first connection member configured for connecting the frame and the chamber flexibly;

a mechanism configured for fixing the extreme ultraviolet light emission position sensor to the frame; and a second connection member for flexibly connecting the chamber, at the periphery of the through-hole, and the frame, at the periphery of the window, to seal the chamber, the second connection member being a flexible pipe.

9. A system for generating extreme ultraviolet light by exciting a target material to turn the target material into plasma, the system comprising:

a frame;

a chamber in which the extreme ultraviolet light is generated and in which a through-hole is formed;

a target supply unit configured for supplying the target material into the chamber;

a first connection member configured for connecting the frame and the chamber flexibly;

a driver laser configured to output a laser beam, with which the target material supplied into the chamber from the target supply unit is irradiated;

a mirror, disposed inside the chamber, for reflecting the laser beam in the chamber;

a beam dump positioned to absorb the laser beam reflected by the mirror;

a fixing member, inserted through the through-hole, for fixing the mirror to the frame; and a second connection member for flexibly connecting the chamber, at the periphery of the through-hole, and the fixing member, to seal the chamber, the second connection member being a flexible pipe.

* * * * *

UNITED STATES PATENT AND TRADEMARK OFFICE

CERTIFICATE OF CORRECTION

PATENT NO. : 8,698,111 B2
APPLICATION NO. : 13/283922
DATED : April 15, 2014
INVENTOR(S) : Toshihiro Nishisaka et al.

It is certified that error appears in the above-identified patent and that said Letters Patent is hereby corrected as shown below:

On the Title page, under Item (73) Assignee, we note that the assignee's name is indicated incorrectly: we request "Gigaphonton Inc." be changed to --Gigaphoton Inc.--

Signed and Sealed this
Twenty-fourth Day of June, 2014

Michelle K. Lee

Michelle K. Lee
*Deputy Director of the United States Patent and Trademark Office*